US011230824B2

(12) United States Patent
Narikawa et al.

(10) Patent No.: US 11,230,824 B2
(45) Date of Patent: Jan. 25, 2022

(54) WORK MACHINE

(71) Applicant: HITACHI CONSTRUCTION MACHINERY CO., LTD., Tokyo (JP)

(72) Inventors: Ryu Narikawa, Tokyo (JP); Hidekazu Moriki, Tokyo (JP); Manabu Edamura, Tsuchiura (JP); Shiho Izumi, Tsuchiura (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 83 days.

(21) Appl. No.: 16/631,505

(22) PCT Filed: Jun. 28, 2018

(86) PCT No.: PCT/JP2018/024609
§ 371 (c)(1),
(2) Date: Jan. 16, 2020

(87) PCT Pub. No.: WO2019/058695
PCT Pub. Date: Mar. 28, 2019

(65) Prior Publication Data

US 2020/0141091 A1 May 7, 2020

(30) Foreign Application Priority Data

Sep. 19, 2017 (JP) ..... JP2017-179134

(51) Int. Cl.
*E02F 9/26* (2006.01)
*E02F 3/32* (2006.01)
(Continued)

(52) U.S. Cl.
CPC ..... *E02F 9/262* (2013.01); *E02F 3/32* (2013.01); *E02F 3/435* (2013.01); *E02F 9/2004* (2013.01);
(Continued)

(58) Field of Classification Search
CPC ... E02F 3/32; E02F 3/435; E02F 3/437; E02F 9/2004; E02F 9/2033; E02F 9/2271; E02F 9/261; E02F 9/262
See application file for complete search history.

(56) References Cited

U.S. PATENT DOCUMENTS 7,532,967 B2 * 5/2009 Fujishima ..... E02F 9/2045 37/341
11,001,992 B2 * 5/2021 Morimoto
(Continued)

FOREIGN PATENT DOCUMENTS

JP 2002-352224 A 12/2002
JP 2014-101664 A 6/2014
(Continued)

OTHER PUBLICATIONS

International Search Report of PCT/JP2018/024609 dated Aug. 28, 2018.
(Continued)

*Primary Examiner* — Tyler J Lee
(74) *Attorney, Agent, or Firm* — Mattingly & Malur, PC

(57) ABSTRACT

A work machine (1) includes a controller (40) having a notification control section (374) that exercises control as to whether to notify an operator of operation support information in accordance with a distance between a predetermined target surface, out of a plurality of discretionally set target surfaces, and a work implement (1A), the work machine including a current terrain profile acquisition device (96) that acquires a position of a current terrain profile, the controller including a target surface comparison section (62) that compares the position of the current terrain profile (800) with a position of the predetermined target surface (700) to determine a vertical position relationship between the current terrain profile and the predetermined target surface. The notification control section (374) changes content of the
(Continued)

operation support information in accordance with a result of determination by the target surface comparison section.

7 Claims, 22 Drawing Sheets

(51) Int. Cl.
*E02F 3/43* (2006.01)
*E02F 9/20* (2006.01)
*E02F 9/22* (2006.01)

(52) U.S. Cl.
CPC ..... *E02F 9/2033* (2013.01); *E02F 9/2271* (2013.01); *E02F 9/261* (2013.01)

(56) References Cited

U.S. PATENT DOCUMENTS

2003/0004645 A1 1/2003 Kochi
2003/0004646 A1 1/2003 Kochi
2005/0027420 A1* 2/2005 Fujishima ..... E02F 9/2045 701/50
2007/0010925 A1* 1/2007 Yokoyama ..... E02F 9/261 701/50
2013/0158785 A1 6/2013 Fukano et al.
2014/0064897 A1 3/2014 Montgomery
2016/0010312 A1 1/2016 Kurihara et al.
2016/0024757 A1* 1/2016 Nomura ..... E02F 9/264 414/687
2016/0076228 A1 3/2016 Nau
2017/0021769 A1* 1/2017 Izumikawa ..... B60K 37/02
2017/0101761 A1 4/2017 Wu
2017/0275854 A1* 9/2017 Izumikawa ..... E02F 9/2808
2018/0002899 A1* 1/2018 Morimoto ..... E02F 9/261
2018/0030694 A1 2/2018 Kanari et al.
2018/0202130 A1* 7/2018 Morimoto ..... E02F 9/2004
2019/0218753 A1* 7/2019 Morimoto ..... E02F 3/435
2019/0360178 A1* 11/2019 Morimoto ..... E02F 9/2004
2021/0140147 A1* 5/2021 Filla ..... E02F 9/264

FOREIGN PATENT DOCUMENTS

JP 2014-205655 A 10/2014
JP 2016-204840 A 12/2016
WO 2015/194601 A1 12/2015

OTHER PUBLICATIONS

International Preliminary Report on Patentability received in corresponding International Application No. PCT/JP2018/024609 dated Apr. 2, 2020.
Extended European Search Report received in corresponding European Application No. 18858018.7 dated Jun. 11, 2021.

* cited by examiner

WORK MACHINE

TECHNICAL FIELD

The present invention relates to a work machine.

BACKGROUND ART

Operation of operation levers by an operator enables a work implement (front work implement) of a work machine typified by a hydraulic excavator configured with the work implement to be driven to shape a terrain profile to be worked into a desired shape. Machine guidance (MG) is known as a technique intended to support such work. The MG is a technique for realizing support of an operator's operation by displaying design surface data indicating the desired shape of a surface to be worked and to be eventually realized and a position relationship of a work implement with the surface to be worked.

JP-2014-101664-A, for example, discloses a display system of an excavating machine which has a work implement having a bucket (work tool) and to which the work implement is attached, the display system including: a work implement condition detection section configured to detect information about a position of a tip end of the bucket; a storage section configured to store positional information about a design surface indicating a design terrain profile and outer shape information about the bucket; and a processing section configured to determine, among a plurality of measurement reference points that are preset along an outer shape of a buttock part of the bucket for measuring a position and that include at least the tip end of the bucket, a measurement reference point closest to the design surface on the basis of the information about the position of the tip end of the bucket and the outer shape information about the bucket. In other words, the display system calculates a shortest distance among distances between the design surface and the bucket. JP-2014-101664-A also describes emitting a warning on the basis of the shortest distance and changing a mode of emitting a sound as the warning.

PRIOR ART DOCUMENT

Patent Document

Patent Document 1: JP-2014-101664-A

SUMMARY OF THE INVENTION

Problem to be Solved by the Invention

In JP-2014-101664-A, the warning for causing an operator to recognize a probability that the distance between the bucket and the design surface is short and that a current terrain profile is excessively excavated (probability of collision of the bucket against the design surface) is emitted only on the basis of the distance between the design surface and the bucket. Owing to this, even when there is no probability of excessively excavating the current terrain profile, the warning is possibly emitted depending on the distance. For example, in a case in which the current terrain profile to be worked (hereinafter, referred to as "current terrain profile") is below the design surface, that is, in a case of placing fill on the current terrain profile, it is unnecessary to emit a warning related to the probability of excessively excavating the current terrain profile by the bucket. Furthermore, frequent emission of unnecessary warnings during filling work makes the operator feel troublesome. In this way, a respect that it is preferable to provide an object only as needed corresponds to not only the warning but also overall notifications of operation support information related to the current terrain profile and the position of the target surface and including the warning and the display of the distance.

An object of the present invention is to provide a work machine capable of notifying an operator of operation support information related to a current terrain profile and a position of a target surface only as needed.

Means for Solving the Problem

The present application includes a plurality of means for solving the problems. As an example, there is provided a work machine including: a multijoint type work implement; a plurality of hydraulic actuators that drive the work implement; an operation device that gives instructions on motions of the hydraulic actuators; a notification device that notifies an operator of operation support information; and a controller having a notification control section that exercises control as to whether to notify the operator of the operation support information on the basis of a distance between a predetermined target surface, out of a plurality of discretionally set target surfaces, and the work implement. The work machine further includes a current terrain profile acquisition device that acquires a position of a current terrain profile to be worked by the work implement, the controller includes a target surface comparison section that compares the position of the current terrain profile with a position of the predetermined target surface to determine a vertical position relationship between the current terrain profile and the predetermined target surface, and the notification control section changes content of the operation support information on the basis of a result of determination by the target surface comparison section.

Advantages of the Invention

According to the present invention, it is possible to prevent notification of unnecessary operation support information and, therefore, prevent an operator from being annoyed with unnecessary operation support information.

MODE FOR CARRYING OUT THE INVENTION

Figure 1:
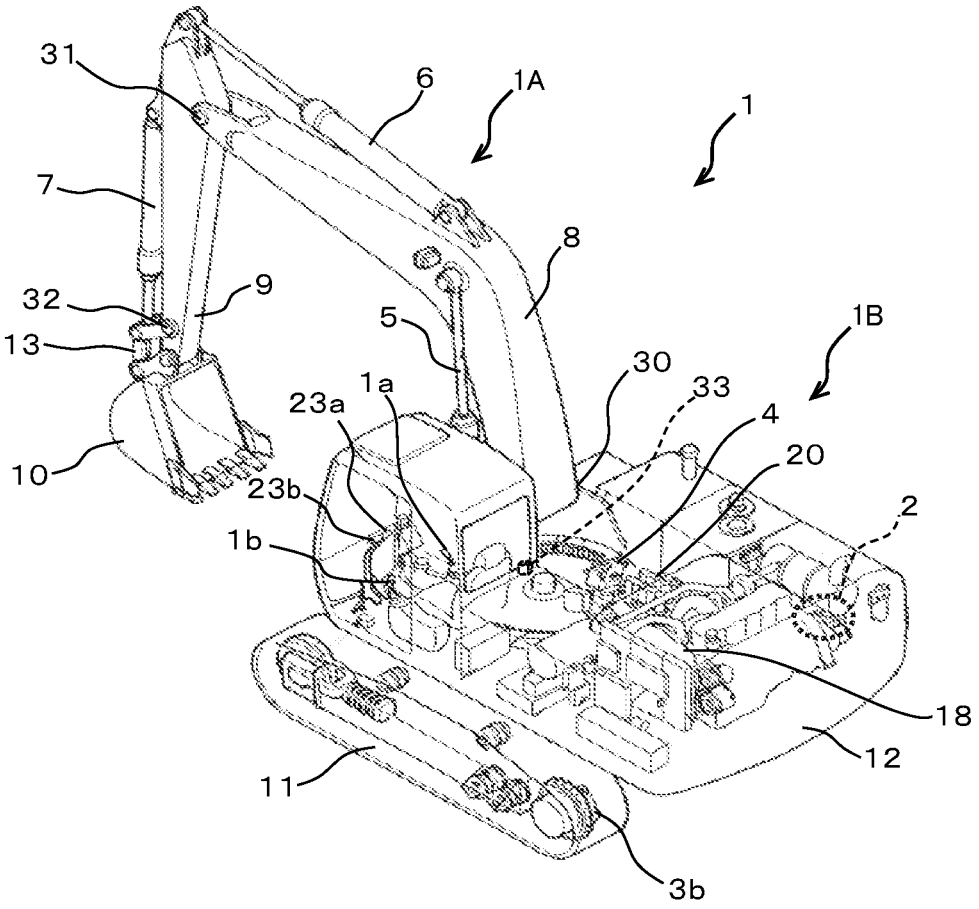
FIG. 1 is a configuration diagram of a hydraulic excavator according to an embodiment of the present invention.

An embodiment of the present invention will be described hereinafter with reference to the drawings. While an example of a hydraulic excavator configured with a bucket 10 as a work tool (attachment) provided on a tip end of a work implement is described below, the present invention may be applied to a work machine configured with an attachment other than the bucket. Furthermore, the present invention is also applicable to a work machine other than a hydraulic excavator as long as the work machine has a multijoint type work implement configured by coupling a plurality of link members (attachment, arm, boom, and the like).

Furthermore, as for meanings of words, "on," "above," or "below" used together with a term indicating a certain shape (for example, a target surface, a design surface and the like), it is assumed in the present paper that "on" means a "surface" of the certain shape, "above" means a "position higher than the surface" of the certain shape, and "below" means a "position lower in position than the surface" of the certain shape. Moreover, in the following description, in a case in which a plurality of same constituent elements are present, alphabets are sometimes added to tail ends of reference characters (numbers); however, the plurality of constituent elements are sometimes denoted generically by omitting the alphabets. For example, when three pumps 300*a*, 300*b*, and 300*c* are present, these are sometimes denoted generically by pumps 300.

<Overall Configuration of Hydraulic Excavator>

Figure 2:
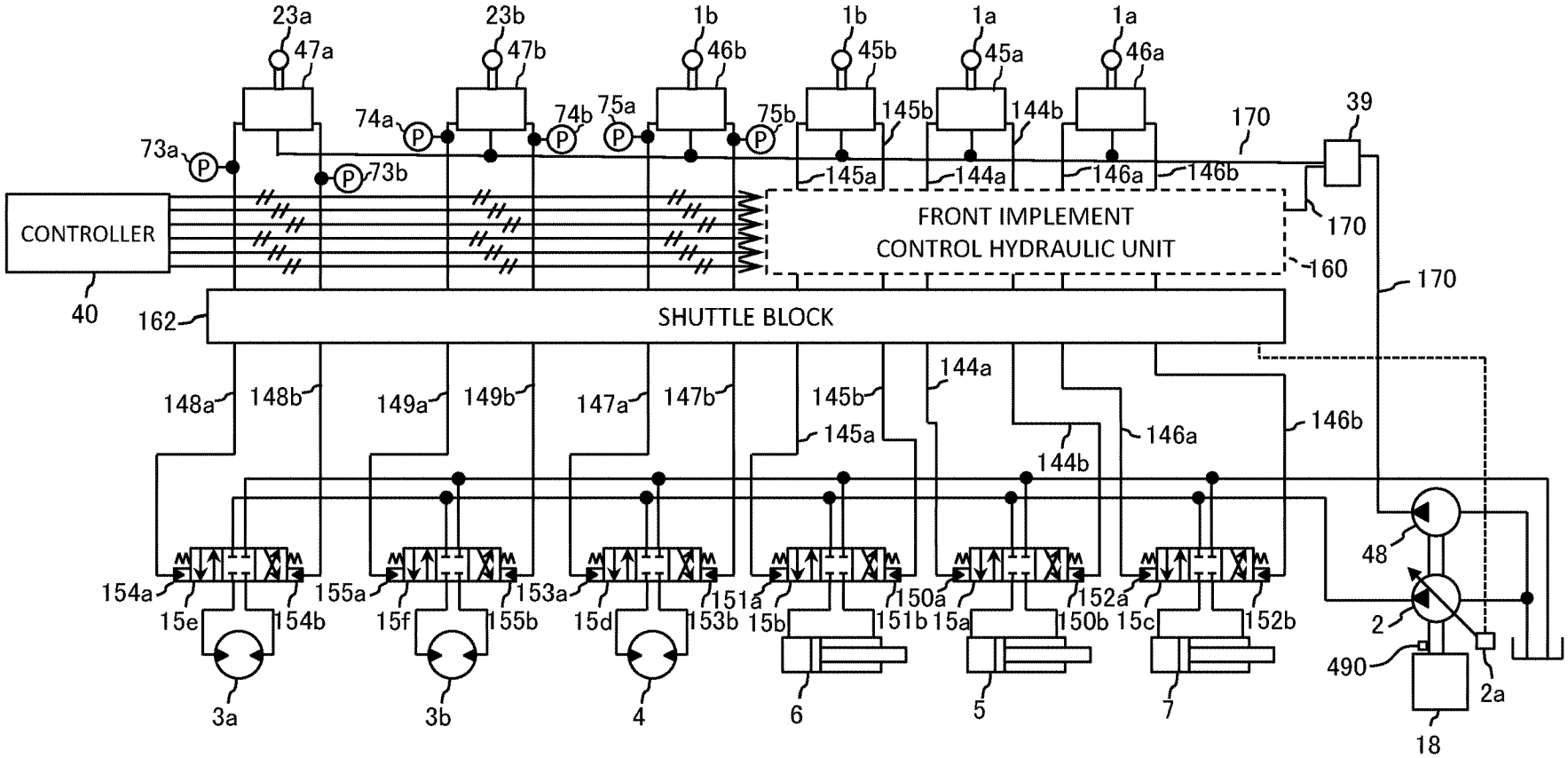
FIG. 2 is a diagram depicting a controller, together with a hydraulic control system, of the hydraulic excavator according to the embodiment of the present invention.
Figure 3:
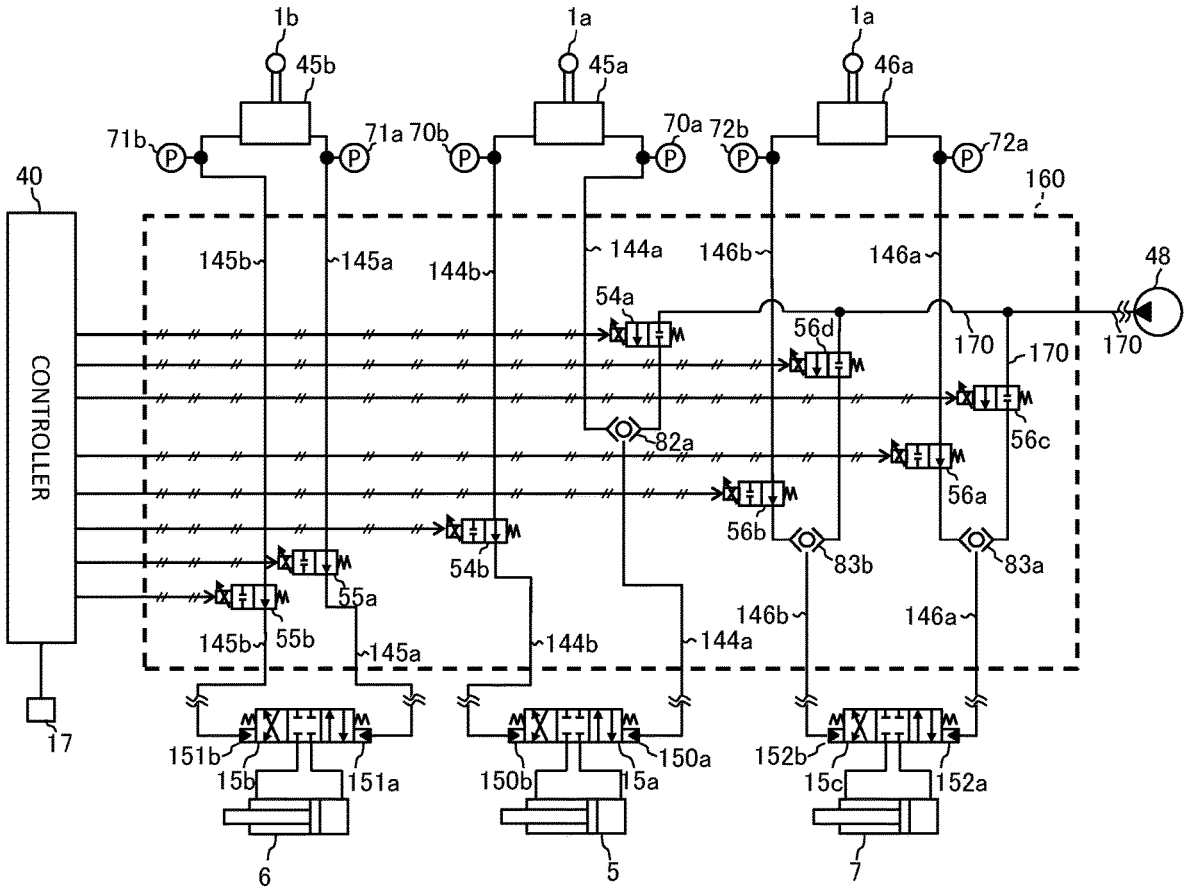
FIG. 3 is a detailed diagram of a front implement control hydraulic unit 160 depicted in FIG. 2.

FIG. 1 is a configuration diagram of a hydraulic excavator according to an embodiment of the present invention, FIG. 2 is a diagram depicting a controller, together with a hydraulic drive system, of the hydraulic excavator according to the embodiment of the present invention, and FIG. 3 is a detailed diagram of a front implement control hydraulic unit 160 depicted in FIG. 2.

In FIG. 1, a hydraulic excavator 1 is configured with a multijoint type front work implement 1A and a machine body 1B. The machine body 1B is configured with a lower travel structure 11 that travels by left and right travel hydraulic motors 3*a* and 3*b* (refer to FIG. 2 for the hydraulic motor 3*a*), and an upper swing structure 12 that is attached onto the lower travel structure 11 and swings by a swing hydraulic motor 4.

The front work implement 1A is configured by coupling a plurality of driven members (a boom 8, an arm 9, and a bucket 10) each rotating in a vertical direction. A base end of the boom 8 is rotatably supported by a front portion of the upper swing structure 12 via a boom pin. The arm 9 is rotatably coupled to a tip end of the boom 8 via an arm pin and the bucket 10 is rotatably coupled to a tip end of the arm 9 via a bucket pin. The boom 8 is driven by a boom cylinder 5, the arm 9 is driven by an arm cylinder 6, and the bucket 10 is driven by a bucket cylinder 7.

A boom angle sensor 30, an arm angle sensor 31, and a bucket angle sensor 32 are attached to the boom pin, the arm pin, and a bucket link 13, respectively, so that rotation angles $\alpha$, $\beta$, $\gamma$ (refer to FIG. 5) of the boom 8, the arm 9, and the bucket 10 can respectively be measured, and a machine body inclination angle sensor 33 that detects an inclination angle $\theta$ (see FIG. 5) of the upper swing structure 12 (machine body 1B) with respect to a reference plane (for example, horizontal plane) is attached to the upper swing structure 12. It is noted that the angle sensors 30, 31, and 32 can be each replaced by an angle sensor that measures a rotation angle with respect to the reference plane (for example, horizontal plane).

Within a cabin provided in the upper swing structure 12, there are provided an operation device 47*a* (FIG. 2) having a travel right lever 23*a* (FIG. 1) and operating the travel right hydraulic motor 3*a* (lower travel structure 11), an operation device 47*b* (FIG. 2) having a travel left lever 23*b* (FIG. 1) and operating the travel left hydraulic motor 3*b* (lower travel structure 11), operation devices 45*a* and 46*a* (FIG. 2) sharing an operation right lever 1*a* (FIG. 1) and operating the boom cylinder 5 (boom 8) and the bucket cylinder 7 (bucket 10), and operation devices 45*b* and 46*b* (FIG. 2) sharing an operation left lever 1*b* (FIG. 1) and operating the arm cylinder 6 (arm 9) and the swing hydraulic motor 4 (upper swing structure 12). The travel right lever 23*a*, the travel left lever 23*b*, the operation right lever 1*a*, and the operation left lever 1*b* are sometimes generically referred to as "operation levers 1 and 23."

An engine 18 that is a prime mover mounted in the upper swing structure 12 drives a hydraulic pump 2 and a pilot pump 48. The hydraulic pump 2 is a variable displacement hydraulic pump at a capacity controlled by a regulator 2*a*, while the pilot pump 48 is a fixed displacement hydraulic pump. As depicted in FIG. 2, in the present embodiment, a shuttle block 162 is provided halfway along pilot lines 144, 145, 146, 147, 148, and 149. Hydraulic signals output from the operation devices 45, 46, and 47 are also input to the regulator 2*a* via this shuttle block 162. While a detailed configuration of the shuttle block 162 is omitted, the hydraulic signals are input to the regulator 2*a* via the shuttle block 162, and a delivery flow rate of the hydraulic pump 2 is controlled in response to the hydraulic signals.

A pump line 170 that is a delivery pipe of the pilot pump 48 is branched off into a plurality of lines after passing through a lock valve 39, and the branch lines are connected to valves of the operation devices 45, 46, and 47, and the front implement control hydraulic unit 160. The lock valve 39 is a solenoid selector valve in the present example, and a solenoid driving section of the lock valve 39 is electrically connected to a position sensor of a gate lock lever (not depicted) disposed within the cabin of the upper swing structure 12. A position of the gate lock lever is detected by the position sensor, and a signal in response to the position of the gate lock lever is input from the position sensor to the lock valve 39. The lock valve 39 is closed to interrupt the pump line 170 when the position of the gate lock lever is a lock position, and is opened to open the pump line 170 when the position thereof is an unlock position. In other words, in a state of interrupting the pump line 170, operations by the operation devices 45, 46, and 47 are made invalid to prohibit motions such as swing and excavation.

The operation devices 45, 46, and 47 are hydraulic pilot type operation devices, and generate pilot pressures (sometimes referred to as "operating pressures") in response to operation amounts (for example, lever strokes) and operation directions of the operation levers 1 and 23 operated by an operator on the basis of a pressurized fluid delivered from the pilot pump 48. The pilot pressures generated in this way are supplied to hydraulic drive sections 150*a* to 155*b* of corresponding flow control valves 15*a* to 15*f* (refer to FIG. 2 or 3) within a control valve unit 20 via the pilot lines 144*a* to 149*b* (refer to FIG. 3) and used as control signals for driving these flow control valves 15*a* to 15*f*.

A pressurized fluid delivered from the hydraulic pump 2 is supplied to the travel right hydraulic motor 3*a*, the travel left hydraulic motor 3*b*, the swing hydraulic motor 4, the boom cylinder 5, the arm cylinder 6, and the bucket cylinder 7 via the flow control valves 15*a*, 15*b*, 15*c*, 15*d*, 15*e*, and 15*f* (refer to FIG. 3). The boom cylinder 5, the arm cylinder 6, and the bucket cylinder 7 expand and contract by the supplied pressurized fluid, whereby the boom 8, the arm 9, and the bucket 10 rotate and a position and a posture of the bucket 10 change. Furthermore, the swing hydraulic motor 4 rotates by the supplied pressurized fluid, whereby the upper swing structure 12 swings with respect to the lower travel structure 11. Moreover, the travel right hydraulic motor 3*a* and the travel left hydraulic motor 3*b* rotate by the supplied pressurized fluid, whereby the lower travel structure 11 travels.

Figure 4:
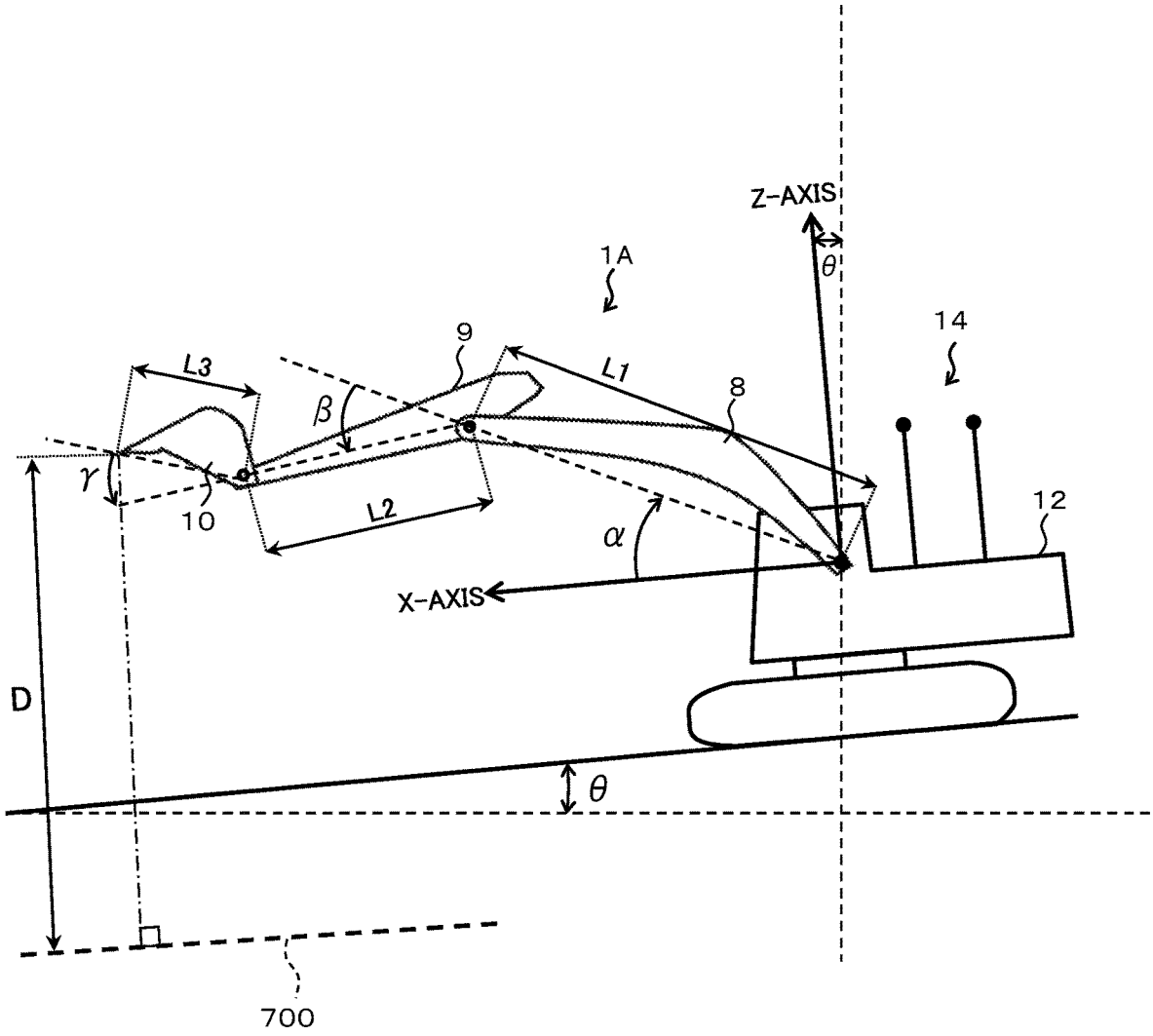
FIG. 4 is a diagram depicting a coordinate system and a target surface for the hydraulic excavator of FIG. 1.

The posture of the work implement 1A can be defined on the basis of excavator reference coordinates of FIG. 4. The excavator reference coordinates of FIG. 4 are coordinates set for the upper swing structure 12, a base of the boom 8 is assumed as an origin, and Z-axis is set in a vertical direction of the upper swing structure 12 and an X-axis is set in a horizontal direction thereof. It is assumed that an inclination angle of the boom 8 with respect to the X-axis is a boom angle α, an inclination angle of the arm 9 with respect to the boom is an arm angle β, and an inclination angle of a bucket claw tip with respect to the arm is a bucket angle γ. It is also assumed that an inclination angle of the machine body 1B (upper swing structure 12) with respect to the horizontal plane (reference plane) is an inclination angle θ. The boom angle α is detected by the boom angle sensor 30, the arm angle β is detected by the arm angle sensor 31, the bucket angle γ is detected by the bucket angle sensor 32, and the inclination angle θ is detected by the machine body inclination angle sensor 33. The boom angle α becomes minimum when the boom 8 is raised to a maximum level (highest level) (when the boom cylinder 5 is at a stroke end in a raising direction, that is, when a boom cylinder length is the largest), and becomes maximum when the boom 8 is lowered to a minimum level (lowest level) (when the boom cylinder 5 is at a stroke end in a lowering direction, that is, when the boom cylinder length is the smallest). The arm angle β becomes minimum when an arm cylinder length is the smallest, and becomes maximum when the arm cylinder length is the largest. The bucket angle γ becomes minimum when a bucket cylinder length is the smallest (as depicted in FIG. 4), and becomes maximum when the bucket cylinder length is the largest. At this time, in a case of assuming that a length from the base portion of the boom 8 to a connection portion between the arm 9 and the boom 8 is L1, a length from the connection portion between the arm 9 and the boom 8 to a connection portion between the arm 9 and the bucket 10 is L2, and a length from the connection portion between the arm 9 and the bucket 10 to a tip end portion of the bucket 10 is L3, and that $X_{bk}$ is an X-direction position and $Z_{bk}$ is a Z-direction position, then a tip end position of the bucket 10 in the excavator reference coordinates can be expressed by the following Equation.

$$X_{bk}=L_1\cos(\alpha)+L_2\cos(\alpha+\beta)+L_3\cos(\alpha+\beta+\gamma) \quad \text{[Equation 1]}$$

$$Z_{bk}=L_1\sin(\alpha)+L_2\sin(\alpha+\beta)+L_3\sin(\alpha+\beta+\gamma) \quad \text{[Equation 2]}$$

Furthermore, the upper swing structure 12 of the hydraulic excavator 1 is configured with a pair of GNSS (Global Navigation Sattelite System) antennas 14A and 14B. A position of the hydraulic excavator 1 and a position of the bucket 10 in a global coordinate system can be calculated on the basis of information from the GNSS antennas 14.

Figure 5:
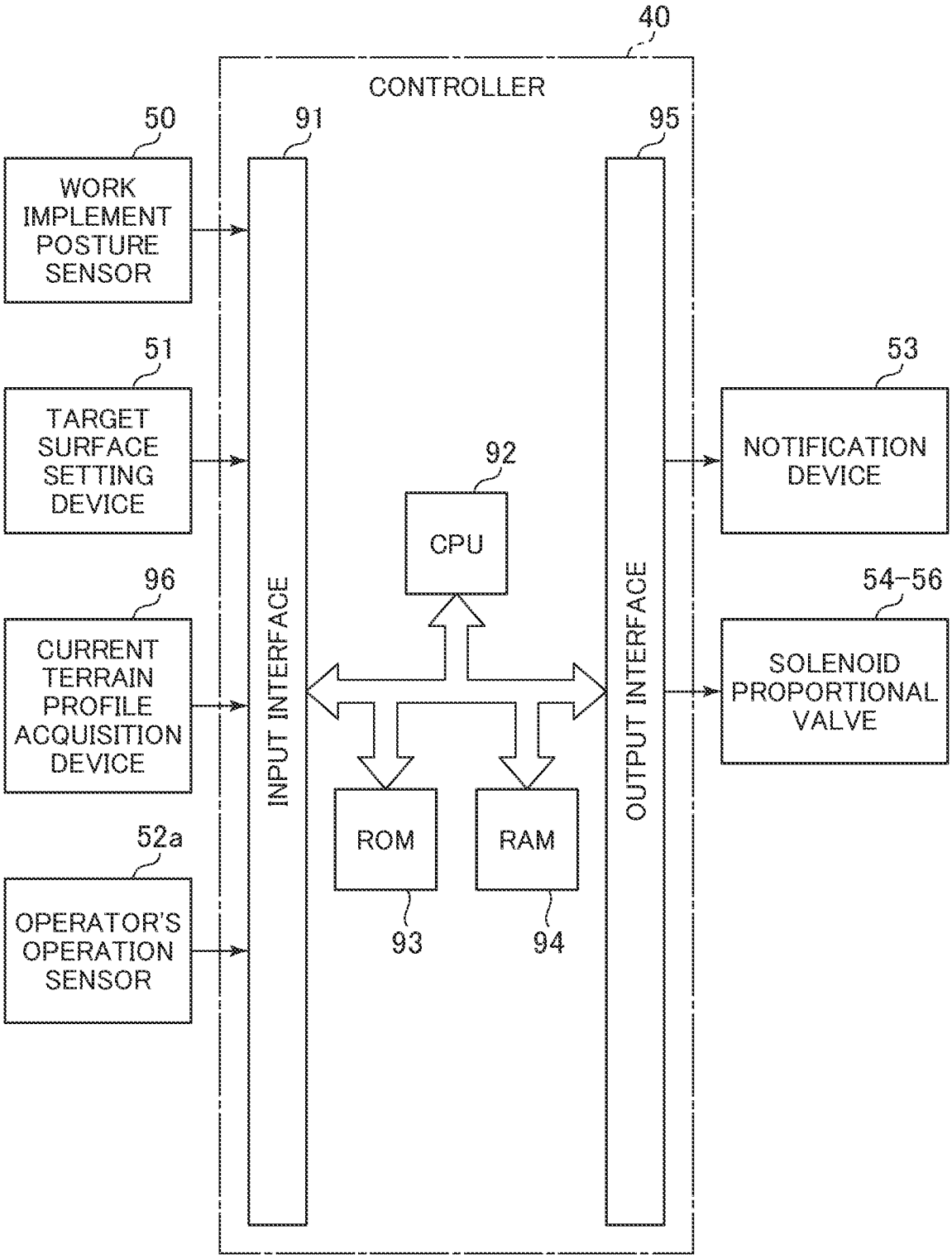
FIG. 5 is a hardware configuration diagram of a controller 40 of the hydraulic excavator.

FIG. 5 is an MG/machine control (MC) system provided in the hydraulic excavator according to the present embodiment. The system of FIG. 5 supports an operator's operation by executing, as MG, a process for notifying the operator of a position relationship between the bucket 10 and a discretionally set target surface 700 via a notification device 53. In addition, the system of FIG. 5 executes, as MC, a process for controlling the front work implement 1A on the basis of a preset condition when the operator operates the operation devices 45 and 46. For example, in the present embodiment, the MC sometimes functions in such a manner as to hold the bucket 10 in an area on or above the discretionally set target surface 700. In the present paper, the MC is sometimes referred to as "semiautomatic control" to control, by a computer, motions of the work implement 1A only when the operation devices 45 and 46 are operated, as opposed to "automatic control" to control, by a computer, the motions of the work implement 1A when the operation devices 45 and 46 are not operated. Details of the MG and the MC in the present embodiment will next be described.

As the MG of the front work implement 1A, the notification device 53 notifies the operator of the position relationship between the target surface 700 (refer to FIG. 4) and a tip end of the work implement 1A. The notification device 53 in the present embodiment is a display device (for example, liquid crystal display) and an audio output device (for example, speaker), and the notification device 53 notifies the operator of operation support information associated with a distance between a claw tip of the bucket 10 and the target surface 700 via these devices. As described later in detail, the operation support information includes, for example, display of the distance between the claw tip of the bucket 10 and the target surface and a warning produced when the bucket 10 approaches the target surface 700. The latter warning includes display of a light bar by the display device and a warning sound by the audio output device. The warning sound is produced by a method of producing, for example, the warning sound as intermittent sounds in a case in which the distance between the target surface 700 and the bucket 10 is in a range from a first threshold to a second threshold (first threshold>second threshold), making shorter an interval of the intermittent sounds as the bucket 10 approaches the target surface 700 in a range smaller than the second threshold, and producing a continuous sound when the bucket 10 is present on the target surface 700 (that is, the distance is zero), for example.

As the MC over the front work implement 1A, in a case in which an excavating operation (specifically, an instruction to perform at least one of arm crowding, bucket crowding, and bucket dumping) is input via the operation device 45*b* or 46*a*, the MG/MC system outputs, to the relevant flow control valve 15*a*, 15*b*, or 15*c*, a control signal to forcibly actuate at least one of the hydraulic actuators 5, 6, and 7 (for example, to expand the boom cylinder 5 to force the boom cylinder 5 to perform a boom raising motion) so that the position of the tip end of the work implement 1A (assumed as the claw tip of the bucket 10 in the present embodiment) can be kept in an area on and above the target surface 700 on the basis of the position relationship between the target surface 700 (refer to FIG. 4) and the tip end of the work implement 1A.

Since this MC prevents the claw tip of the bucket 10 from entering an area below the target surface 700, it is possible to perform excavation along the target surface 700 regardless of a degree of an operator's skill. It is noted that a control point over the front work implement 1A at the time of the MC is set to the claw tip of the bucket 10 of the hydraulic excavator (tip end of the work implement 1A) in the present embodiment; however, the control point can be changed to a point other than the bucket claw tip as long as the point is present in the tip end portion of the work implement 1A.

The system of FIG. 5 is configured with a work implement posture sensor 50, a target surface setting device 51, an operator's operation sensor 52*a*, the notification device 53 that is installed in the cabin and that can notify an operator of the position relationship between the target surface 700 and the work implement 1A, a current terrain profile acquisition device 96 that acquires position information about a current terrain profile 800 to be worked by the work implement 1A, and a controller 40 that is a computer in charge of the MG and the MC.

The work implement posture sensor 50 is configured with the boom inclination sensor 30, the arm angle sensor 31, the bucket angle sensor 32, and the machine body inclination angle sensor 33. These angle sensors 30, 31, 32, and 33 function as posture sensors for the work implement 1A.

The target surface setting device 51 is an interface to which information about the target surface 700 (containing position information about each target surface and inclination angle information) can be input. The target surface setting device 51 is connected to an external terminal (not depicted) that stores three-dimensional data about the target surface specified in a global coordinate system (absolute coordinate system). It is noted that an operator may manually input the target surface via the target surface setting device 51.

The operator's operation sensor 52*a* is configured from pressure sensors 70*a*, 70*b*, 71*a*, 71*b*, 72*a*, and 72*b* that acquire operating pressures (first control signals) generated in the pilot lines 144, 145, and 146 by operation of the operation levers 1*a* and 1*b* (operation devices 45*a*, 45*b*, and 46*a*) by an operator. In other words, the operator's operation sensor 52*a* detects operations on the hydraulic cylinders 5, 6, and 7 related to the work implement 1A.

As the current terrain profile acquisition device 96, a stereo camera, a laser scanner, or an ultrasonic sensor, for example, provided in the excavator 1 can be used. Each of these devices measures a distance from the excavator 1 to a point on the current terrain profile, and the current terrain profile acquired by the current terrain profile acquisition device 96 is defined by position data about a point group of an enormous amount. It is noted that the current terrain profile acquisition device 96 may be configured to acquire, in advance, three-dimensional data about the current terrain profile by a drone or the like that mounts therein the stereo camera, the laser scanner, the ultrasonic sensor, or the like, and to function as an interface for capturing the three-dimensional data into a controller 40.

<Front Implement Control Hydraulic Unit 160>

As depicted in FIG. 3, a front implement control hydraulic unit 160 is configured with the pressure sensors 70*a* and 70*b* that are provided in the pilot lines 144*a* and 144*b* of the operation device 45*a* for the boom 8 and that detect pilot pressures (first control signals) as operation amounts of the operation lever 1*a*, a solenoid proportional valve 54*a* that has a primary port side connected to the pilot pump 48 via the pump line 170 and that reduces the pilot pressure from the pilot pump 48 to output the reduced pilot pressure, a shuttle valve 82*a* that is connected to the pilot line 144*a* of the operation device 45*a* for the boom 8 and a secondary port side of the solenoid proportional valve 54*a*, that selects a higher pressure out of the pilot pressure in the pilot line 144*a* and a control pressure (second control signal) output from the solenoid proportional valve 54*a*, and that guides the selected pressure to the hydraulic drive section 150*a* of the flow control valve 15*a*, and a solenoid proportional valve 54*b* that is installed in the pilot line 144*b* of the operation device 45*a* for the boom 8 and that reduces the pilot pressure (first control signal) in the pilot line 144*b* on the basis of a control signal from the controller 40 to output the reduced pilot pressure.

Furthermore, the front implement control hydraulic unit 160 is configured with the pressure sensors 71*a* and 71*b* that are installed in the pilot lines 145*a* and 145*b* for the arm 9, that detect pilot pressures (first control signals) as operation amounts of the operation lever 1*b* and that output the detected pilot pressures to the controller 40, a solenoid proportional valve 55*b* that is installed in the pilot line 145*b* and that reduces the pilot pressure (first control signal) on the basis of the control signal from the controller 40 to output the reduced pilot pressure, and solenoid proportional valve 55*a* that is installed in the pilot line 145*a* and that reduces the pilot pressure (first control signal) in the pilot line 145*b* on the basis of the control signal from the controller 40 to output the reduced pilot pressure.

Moreover, the front implement control hydraulic unit 160 is configured with the pressure sensors 72*a* and 72*b* that are installed in the pilot lines 146*a* and 146*b* for the bucket 10, that detect pilot pressures (first control signals) as operation amounts of the operation lever 1*a*, and that output the detected pilot pressures to the controller 40, solenoid proportional valves 56*a* and 56*b* that reduce the pilot pressures (first control signals) on the basis of a control signal from the controller 40 to output the reduced pilot pressures, solenoid proportional valves 56*c* and 56*d* that have primary port sides connected to the pilot pump 48 and that reduce the pilot pressure from the pilot pump 48 to output the reduced pilot pressure, and shuttle valves 83*a* and 83*b* each of which selects a higher pressure out of the pilot pressure in the pilot line 146*a* or 146*b* and a control pressure output from the solenoid proportional valve 56*c* or 56*d* and each of which guides the selected pressure to the hydraulic drive section 152*a* or 152*b* of the flow control valve 15*c*. It is noted that connection lines between the pressure sensors 70, 71, and 72 and the controller 40 are omitted in FIG. 3 due to space limitations.

Opening degrees of the solenoid proportional valves 54*b*, 55*a*, 55*b*, 56*a*, and 56*b* are maximum when currents are not carried, and become smaller as the currents that are the control signals from the controller 40 are increased. On the other hand, opening degrees of the solenoid proportional valves 54*a*, 56*c*, and 56*d* are zero when currents are not carried, are not zero when currents are carried, and become larger as the currents (control signals) from the controller 40 are increased. In this way, the opening degrees 54, 55, and 56 of the solenoid proportional valves are in response to the control signals from the controller 40.

In the control hydraulic unit 160 configured as described above, when the controller 40 outputs the control signals to drive the solenoid proportional valves 54*a*, 56*c*, and 56*d*, pilot pressures (second control signals) can be generated even without operator's operation of the corresponding operation devices 45*a* and 46*a*; thus, it is possible to forcibly generate a boom raising motion, a bucket crowding motion, or a bucket dumping motion. Likewise, when the controller 40 drives the solenoid proportional valves 54*b*, 55*a*, 55*b*, 56*a*, and 56*b*, pilot pressures (second control signals) can be generated by reducing the pilot pressures (first control signals) generated by operator's operation of the operation devices 45*a*, 45*b*, and 46*a*; thus, it is possible to forcibly reduce a velocity of a boom lowering motion, an arm crowding/dumping motion, or a bucket crowding/dumping motion from an operator's operation value.

In the present paper, among the control signals for the flow control valves 15*a* to 15*c*, the pilot pressures generated by operating the operation devices 45*a*, 45*b*, and 46*a* will be referred to as "first control signals." In addition, among the control signals for the flow control valves 15*a* to 15*c*, the pilot pressures generated by correcting (reducing) the first control signals by causing the controller 40 to drive the solenoid proportional valves 54*b*, 55*a*, 55*b*, 56*a*, and 56*b*, and the pilot pressures newly generated independently of the first control signals by causing the controller 40 to drive the solenoid proportional valves 54*a*, 56*c*, and 56*d* will be referred to as "second control signals."

The second control signals are generated when a velocity vector of the control point over the work implement 1A generated by the first control signals is against a predetermined condition, and are generated as control signals for generating a velocity vector of the control point over the work implement 1A that is not against the predetermined condition. In a case in which the first control signal is generated for one of the hydraulic drive sections of any of the flow control valves 15*a* to 15*c* and the second control signal is generated for the other hydraulic drive section, it is assumed that the second control signal is allowed to preferentially act on the hydraulic drive section, the first control signal is interrupted by the solenoid proportional valve, and the second control signal is input to the other hydraulic drive section. Therefore, among the flow control valves 15*a* to 15*c*, each of those for which the second control signals are computed is controlled on the basis of the second control signal, each of those for which the second control signals are not computed is controlled on the basis of the first control signal, and each of those for which neither the first control signals nor the second control signals are not generated is not controlled (driven). In a case of defining the first control signals and the second control signals as described above, it can also be said that the MC is control over the flow control valves 15*a* to 15*c* on the basis of the second control signals.

<Controller 40>

In FIG. 5, the controller 40 has an input interface 91, a central processing unit (CPU) 92 that is a processor, a read only memory (ROM) 93 and a random access memory (RAM) 94 that are storage devices, and an output interface 95. Signals from the angle sensors 30 to 32 and the inclination angle sensor 33 that configure the work implement posture sensor 50, a signal from the target surface setting device 51 that is a device for setting the target surface 700, a signal from the current terrain profile acquisition device 96 that acquires the current terrain profile 800 are input to the input interface 91, and the input interface 91 converts the signals in such a manner that the CPU 92 can perform computing. The ROM 93 is a recording medium that stores a control program for executing the MG including processes related to flowcharts to be described later, various kinds of information necessary to execute the flowcharts, and the like, and the CPU 92 performs predetermined computing processes on the signals imported from the input interface 91, the ROM 93, and the RAM 94 in accordance with the control program stored in the ROM 93. The output interface 95 creates signals to be output in response to computing results of the CPU 92 and outputs the signals to the notification device 53, thereby displaying images of the machine body 1B, the bucket 10, the target surface 700, and the like on a screen of the notification device 53.

While the controller 40 of FIG. 5 is configured with the ROM 93 and the RAM 94 that are semiconductor memories as the storage devices, the semiconductor memories can be replaced by other devices as long as the devices are storage devices. For example, the controller 40 may be configured with a magnetic storage device such as a hard disk drive.

Figure 6:
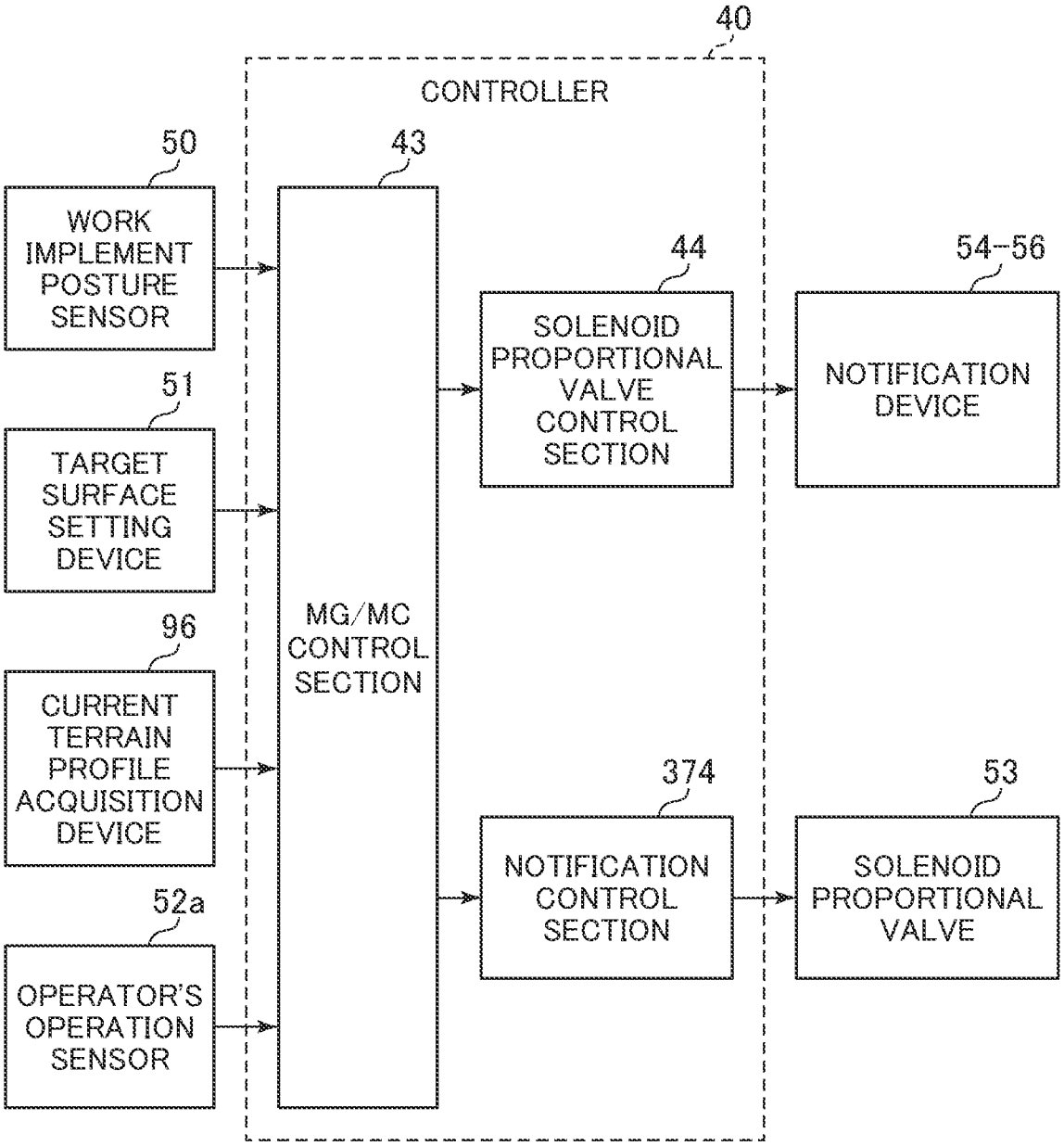
FIG. 6 is a functional block diagram of the controller 40 of the hydraulic excavator.

FIG. 6 is a functional block diagram of the controller 40. The controller 40 is configured with an MG/MC control section 43, a solenoid proportional valve control section 44, and a notification control section 374.

The notification control section 374 is a part that controls content of the operation support information (hereinafter, often referred to as "notification content") of which an operator is notified by the notification device 53 on the basis of information output from the MG/MC control section 43 (for example, information about a work implement posture and the target surface, and the like). The notification control section 374 is configured with a display ROM that stores a great deal of display-associated data containing images and icons of the work implement 1A, and the notification control section 374 reads a predetermined program on the basis of flags (for example, a notification content change flag depicted in FIG. 18 and an MG target surface change flag depicted in FIG. 19) contained in the input information and exercises display control over the notification device (display device) 53. The notification control section 374 also controls content of a sound output from the notification device (audio output device) 53. The notification control section 374 further determines whether to display a light bar or to notify the operator of a warning sound as a warning (operation support information) associated with the distance between a predetermined target surface out of a plurality of preset target surfaces and the bucket 10 on the basis of the distance between the predetermined target surface and the bucket 10.

<MG/MC Control Section 43>

Figure 7:
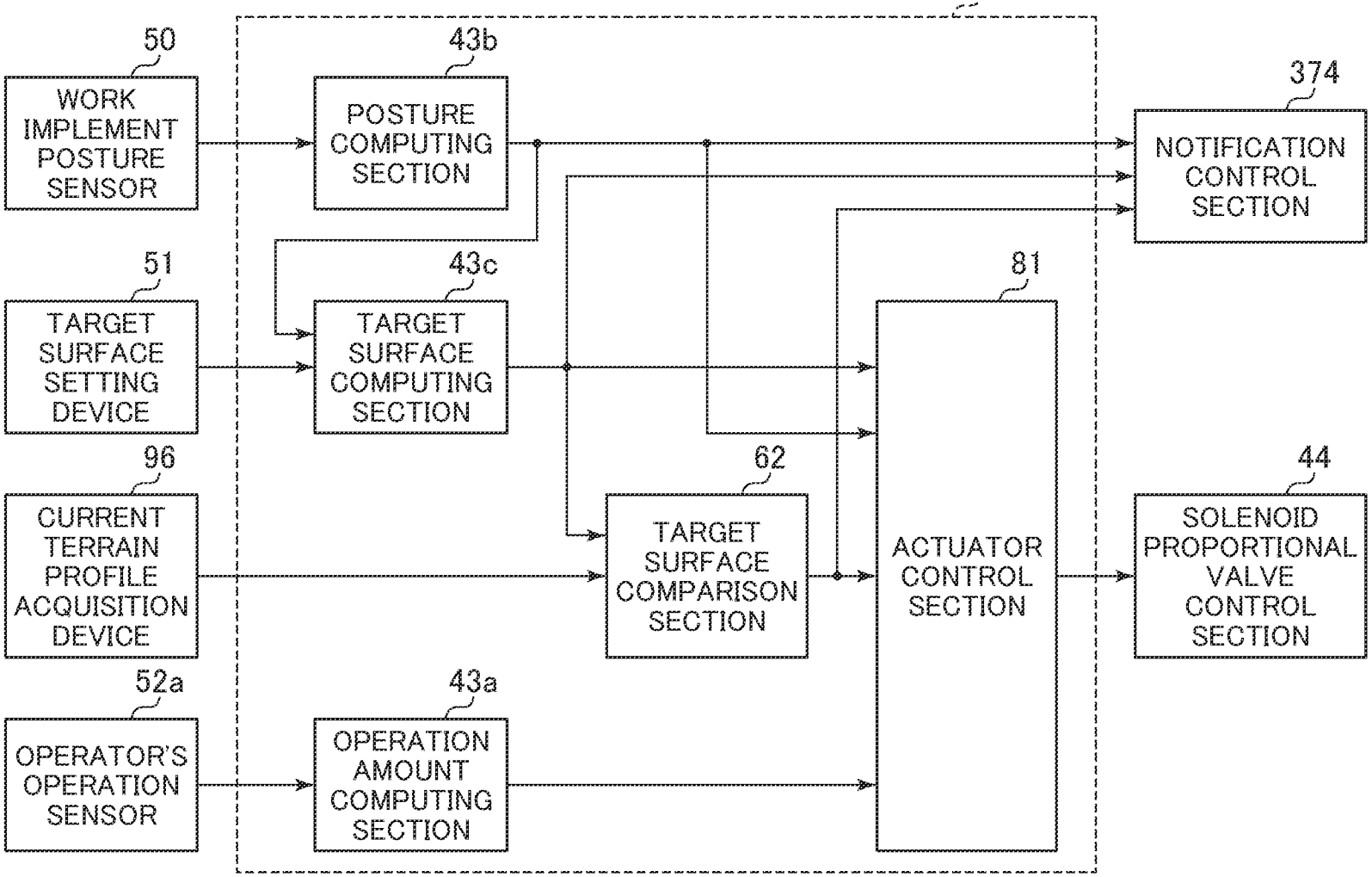
FIG. 7 is a functional block diagram of an MG/MC control section 43 depicted in FIG. 6.

FIG. 7 is a functional block diagram of the MG/MC control section 43 depicted in FIG. 6. The MG/MC control section 43 is configured with an operation amount computing section 43*a*, a posture computing section 43*b*, a target surface computing section 43*c*, an actuator control section 81, and a target surface comparison section 62.

The operation amount computing section 43*a* calculates operation amounts of the operation devices 45*a*, 45*b*, and 46*a* (operation levers 1*a* and 1*b*) on the basis of inputs from the operator's operation sensor 52*a*. The operation amount computing section 43*a* can calculate the operation amounts of the operation devices 45*a*, 45*b*, and 46*a* from detection values of the pressure sensors 70, 71, and 72.

It is noted that the calculation of the operation amounts by the pressure sensors 70, 71, and 72 is given as an example and that operation amounts of the operation levers of the operation devices 45*a*, 45*b*, and 46*a* may, for example, be detected by position sensors (for example, rotary encoders) detecting rotation displacements of the operation levers thereof. Furthermore, as an alternative to the configuration of calculating motion velocities from the operation amounts, a configuration such that stroke sensors that detect expansion/contraction amounts of the hydraulic cylinders 5, 6, and 7 are attached and the motion velocities of the cylinders are calculated on the basis of changes in the detected expansion/contraction amounts over time is also applicable.

The posture computing section 43*b* computes the posture of the front work implement 1A and the position of the claw tip of the bucket 10 in a local coordinate system (excavator reference coordinate system) on the basis of the information from the work implement posture sensor 50. As already described, the claw tip position of the bucket 10 ($X_{bk}$,$Z_{bk}$) can be computed by Equations (1) and (2).

The target surface computing section 43*c* computes position information about the target surface 700 on the basis of the information from the target surface setting device 51 and stores this position information in the RAM 94. As depicted in FIG. 4, in the present embodiment, a cross-sectional shape obtained by cutting a three-dimensional target plane by a plane in which the work implement 1A moves (motion plane of the work implement) is used as the target surface 700 (two-dimensional target surface).

While the number of target surfaces 700 is one in an example of FIG. 4, there are cases where a plurality of target surfaces is present. In a case in which a plurality of target surfaces is present, examples of a method of setting the target surface include a method of setting a surface at a shortest distance from the work implement 1A as the target surface, a method of setting a surface located below the bucket claw tip as the target surface, and a method of setting a discretionally selected surface as the target surface.

Figure 16:
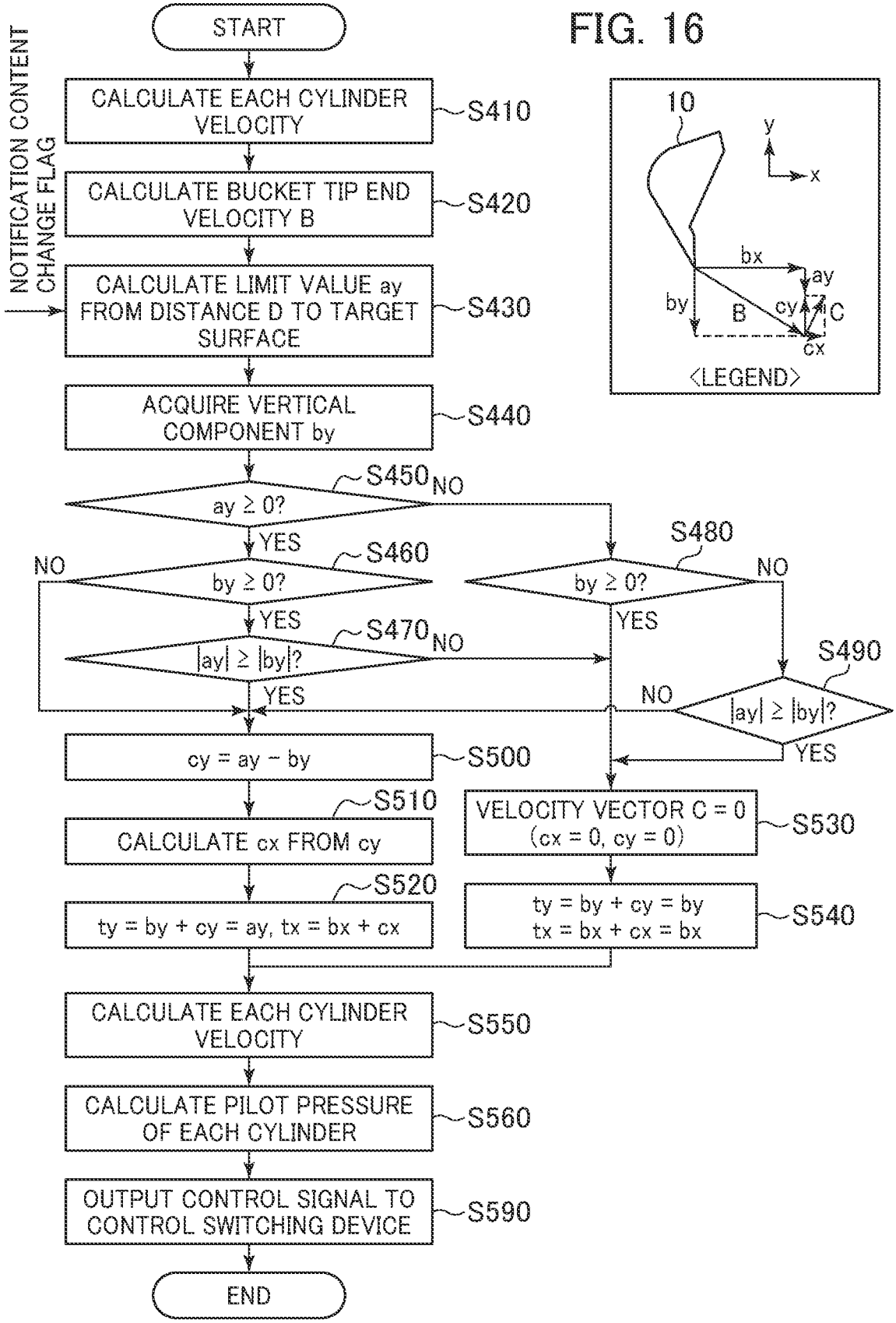
FIG. 16 is a flowchart depicting boom raising control by an actuator control section 81.
Figure 17:
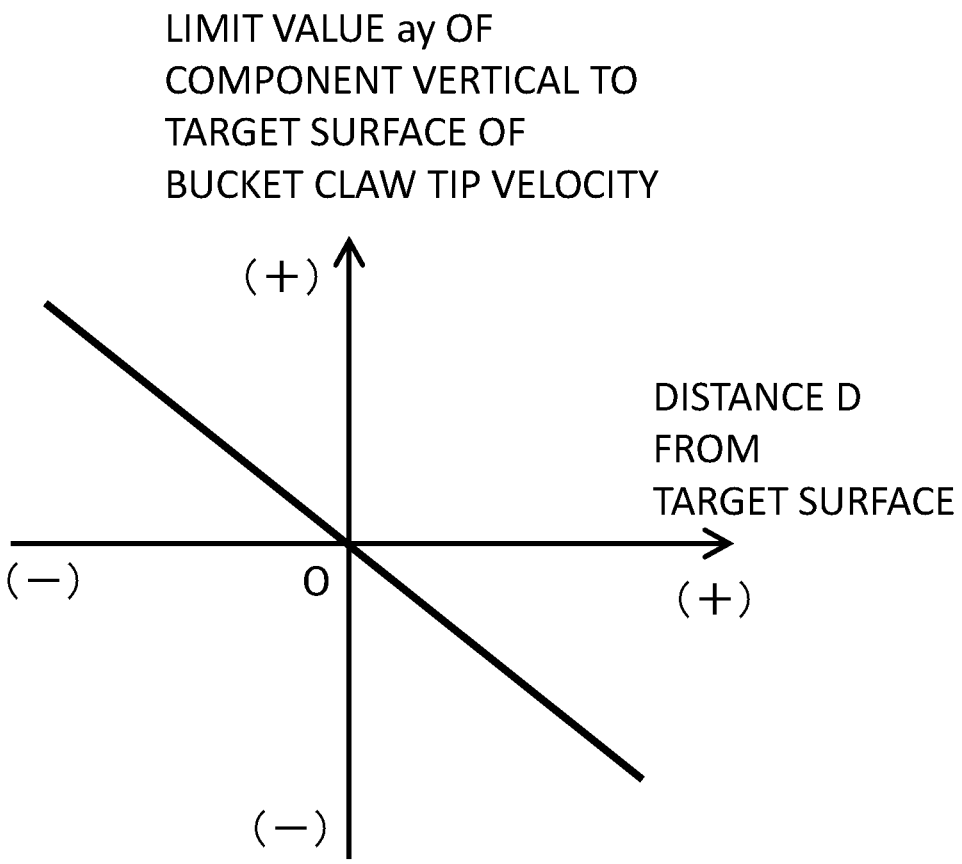
FIG. 17 is a relationship diagram between a distance D and a limit value "ay" in a case in which a notification content change flag is lowered.
Figure 21:
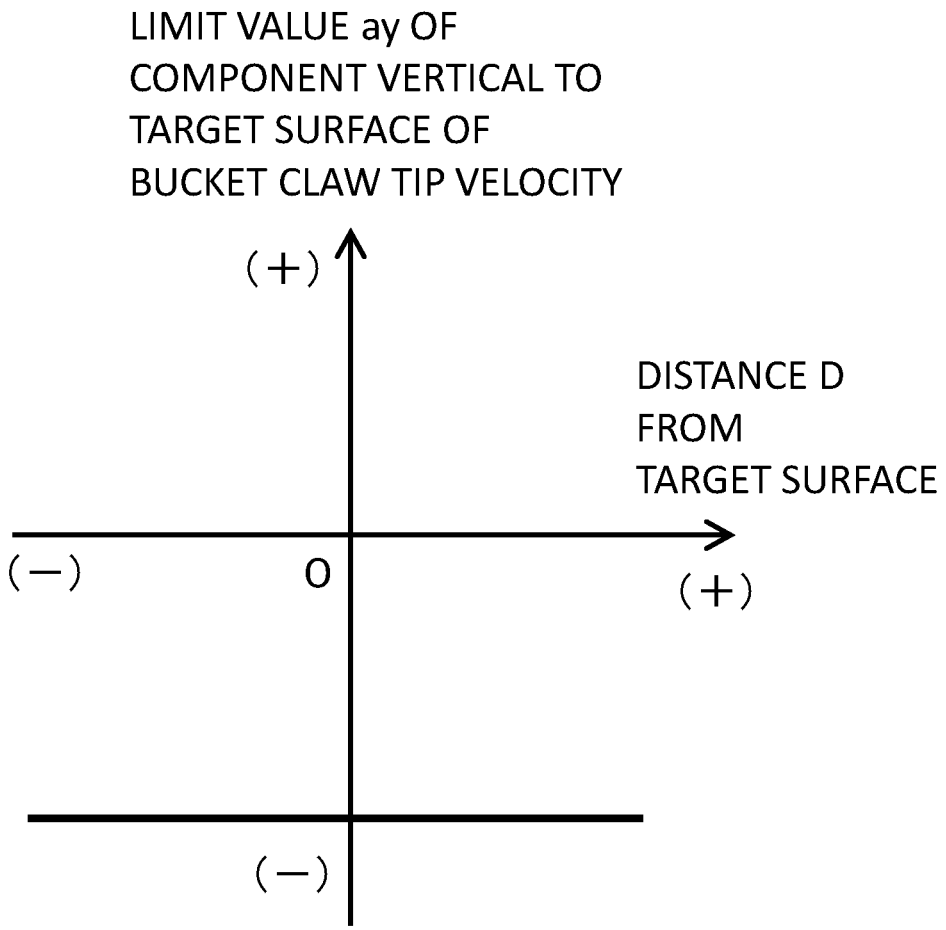
FIG. 21 is a relationship diagram between the distance D and the limit value "ay" in a case in which the notification content change flag is raised.

The actuator control section 81 controls at least one of the plurality of hydraulic actuators 5, 6, and 7 in accordance with a preset condition when the operation devices 45*a*, 45*b*, and 46*a* are operated. The actuator control section 81 in the present embodiment executes the MC to control the motion of the boom cylinder 5 (boom 8) in such a manner that the claw tip of the bucket 10 (control point) is located on or above the target surface 700, on the basis of the position of the target surface 700, the posture of the work implement 1A, the position of the claw tip of the bucket 10, and the operation amounts of the operation devices 45*a*, 45*b*, and 46*b*, when the operation devices 45*a*, 45*b*, and 46*a* are operated, as depicted in FIGS. 16, 17, and 21 to be described later. The actuator control section 81 computes target pilot pressures which are to act on the flow control valves 15*a*, 15*b*, and 15*c* for the hydraulic cylinders 5, 6, and 7, and outputs the computed target pilot pressures to the solenoid proportional valve control section 44. In addition, the actuator control section 81 changes over the control content of the MC (specifically, motion range of the work implement 1A limited by the MC) depending on presence/absence of the notification content change flag. Details of the MC by the actuator control section 81 will be described later with reference to FIGS. 16, 17, and 21.

The target surface comparison section 62 is a part that compares the position of the current terrain profile 800 with the position of the predetermined target surface 700 to determine a vertical position relationship between the current terrain profile 800 and the target surface 700. The target surface comparison section 62 outputs a determination result to the actuator control section 81 and the notification control section 374 as flags (for example, the notification content change flag depicted in FIG. 18 and the MG target surface change flag depicted in FIG. 19).

The solenoid proportional valve control section 44 computes commands to the solenoid proportional valves 54 to 56 on the basis of the target pilot pressures output from the actuator control section 81 to the flow control valves 15*a*, 15*b*, and 15*c*. It is noted that the corresponding solenoid proportional valves 54 to 56 do not operate since current values (command values) to the corresponding solenoid proportional valves 54 to 56 are zero in a case in which the pilot pressures (first control signals) based on the operator's operation match the target pilot pressures calculated by the actuator control section 81.

The notification control section 374 exercises control as to how to notify the operator of posture information computed by the posture computing section 43*b* and target surface information computed by the target surface computing section 43*c* on the basis of a result of comparison by the target surface comparison section 62.

<Target Surface Comparison Section 62>

Details of processes performed by the target surface comparison section 62 will next be described. The target surface comparison section 62 determines the vertical position relationship between the current terrain profile 800 and the target surface 700, and outputs the notification content change flag and the MG target surface change flag based on the determination result to the actuator control section 81 and the notification control section 374. Before describing an output process for outputting the notification content change flag and the MG target surface change flag, a method of determining the vertical position relationship between the current terrain profile 800 and the target surface 700 will first be described with reference to FIG. 8.

Figure 8:
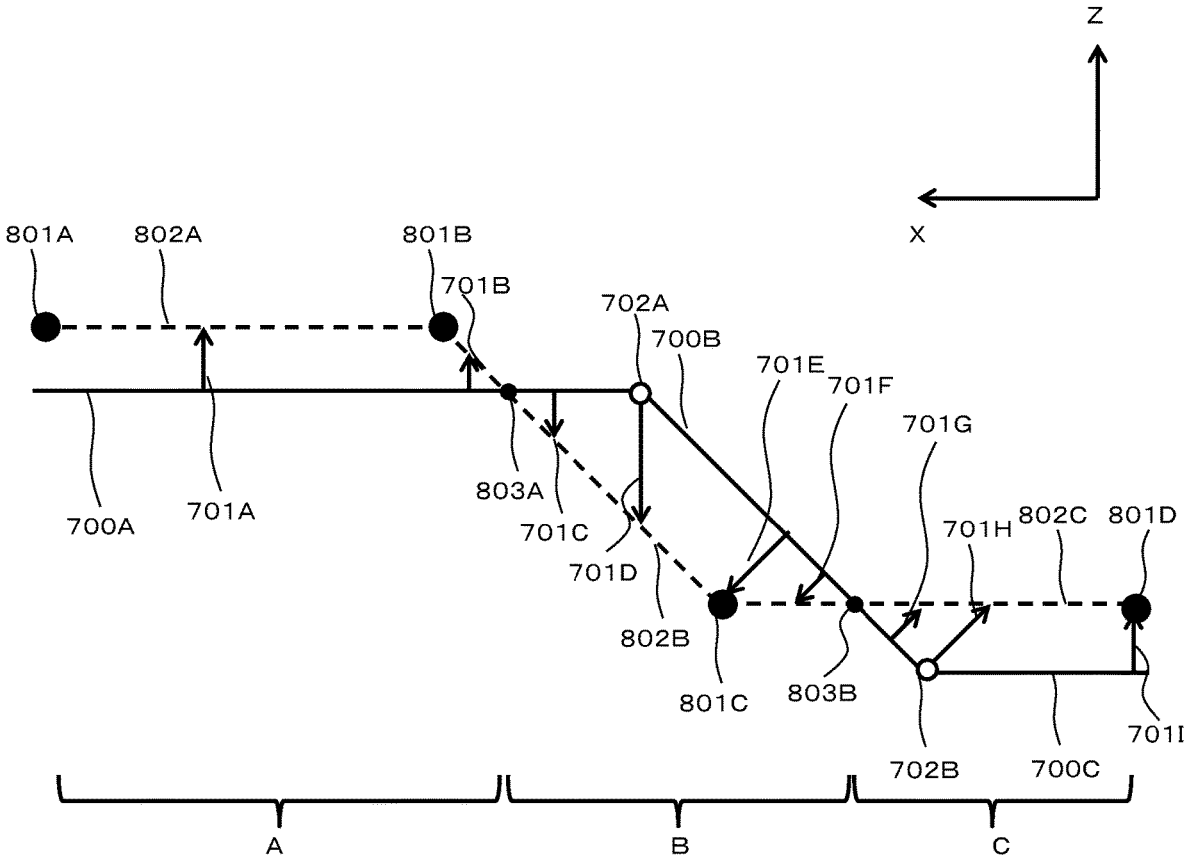
FIG. 8 is an explanatory diagram of a method of determining a vertical position relationship between a current terrain profile 800 and a target surface 700 by a target surface comparison section 62.

As depicted in FIG. 8, position information about the current terrain profile 800 acquired via the current terrain profile acquisition device 96 is input to the target surface comparison section 62 as, for example, a point group 801 converted into excavator reference coordinates. The input point group 801 is expressed as a plurality of segments 802 by, for example, connecting the point group 801 by segments. The target surface comparison section 62 acquires the target surface 700 in the excavator reference coordinates from the target surface comparison section 43*c*. A single target surface 700 or a plurality of target surfaces 700 is used.

The target surface comparison section 62 compares the position of the target surface 700 in the excavator reference coordinates with positions of the straight lines 802 expressing the current terrain profile to determine the position relationship. In the present embodiment, comparison methods (1) to (3) are used as follows. The comparison methods will be described in a situation in which the target surface 700 includes target surfaces 700A, 700B, and 700C and the segments 802 include segments 802A, 802B, and 802C.

(1) In the present embodiment, in principle, a normal of one segment of the target surface 700, on the basis of which the MG and the MC is performed, passing through a given point on one segment of the current terrain profile 800 is created, and the target surface comparison section 62 determines the vertical position relationship between the target surface 700 and the current terrain profile 800 from a direction (sign) of a Z-direction component of the normal. In FIG. 8, for example, among normals of the target surface 700A, a normal passing through a given point on the segment 802A can be calculated as a normal 701A. Since the Z-direction component of the normal 701A is in a positive direction, the target surface comparison section 62 can determine that the segment 802A is located above the target surface 700A.

(2) Furthermore, in the present embodiment, an intersection point between one segment of the target surface 700 and one segment of the current terrain profile 800 is searched, and a normal passing through a point on the segment of the target surface 700 apart from the intersection point by a predetermined distance in a positive X direction and the segment of the current terrain profile 800 is created, while a normal passing through a point on the segment of the target surface 700 apart from the intersection point by the predetermined distance in a negative X direction and the segment of the current terrain profile 800 is created. The target surface comparison section 62 then determines the vertical position relationship between the target surface 700 and the current terrain profile 800 in a range before and after the intersection point from directions (signs) of Z-direction components of the two normals.

In FIG. 8, for example, the target surface comparison section 62 can determine that the target surface 700A and the segments 802B intersect each other at an intersection point 803A. Therefore, among normals of the target surface 700A, a normal starting at a more positive position than the intersection point 803A in the X direction as a starting point and passing through the segment 802B is assumed as a normal 701B, and a normal starting at a more negative position than the intersection point 803A in the X direction as a starting point and passing through the segment 802B is assumed as a normal 701C. Here, since a Z-direction component of the normal 701B is in the positive direction, the target surface comparison section 62 can determine that the segment 802B is located above the target surface 700A at the more positive position than the intersection point 803A in the X direction. In addition, since a Z-direction component of the normal 701C is in a negative direction, the target surface comparison section 62 can determine that the segment 802B is located below the target surface 700A at the more negative position than the intersection point 803A in the X direction.

(3) Furthermore, in the present embodiment, an inflection point of one segment of the target surface 700 is searched, a normal passing through the inflection point and one segment of the current terrain profile 800 is created, and the target surface comparison section 62 determines the vertical position relationship between the target surface 700 (inflection point) and the current terrain profile 800 from a direction of a Z-direction component of the normal. The inflection point represents a connection point between the target surfaces 700 having different inclinations. For example, the target surfaces 700A and 700B are connected to each other at an inflection point 702A. Since a Z-direction component of a normal 701D that is a normal of the target surface 700A and that passes through the inflection point 702A and the segment 802B is in the negative direction, the target surface comparison section 62 can determine that the inflection point 702A is located above the segment 802B.

A normal 701E of the target surface 700B is created on the basis of the method (1) above in such a manner as to pass through a connection point 801C between the segments 802B and 802C, and a Z-direction component of the normal 701E is in a negative direction. The target surface comparison section 62 can, therefore, determine that the target surface 700B is located above the segment 802B.

Next, the target surface comparison section 62 can determine that the target surface 700B and the segment 802C intersect each other at an intersection point 803B. Therefore, among normals of the segment 700B, a normal starting at a more positive position than the intersection point 803B in the X direction as a starting point and passing through the segment 802C is calculated as a normal 701F, and a normal starting at a more negative position than the intersection point 803B as a starting point and passing through the segment 802C is calculated as a normal 701G, on the basis of the method (2) above. Here, since a Z-direction component of the normal 701F is in the negative direction, the target surface comparison section 62 can determine that the segment 802C is located below the target surface 700B at the more positive position than the intersection point 803B in the X direction. In addition, since a Z-direction component of the normal 71G is in the negative direction, the target surface comparison section 62 can determine that the segment 802C is located above the target surface 700B at the more positive position than the intersection point 803B in the X direction.

Next, the target surfaces 700B and 700C are connected to each other at an inflection point 702B. Therefore, a normal 701H passing through the inflection point 702B and the segment 802C is created on the basis of the method (3) above. Since a Z-direction component of the normal 701H is in the positive direction, the target surface comparison section 62 can determine that the inflection point 702B is located below the segment 802C.

Furthermore, a normal 701I of the target surface 700C passing through a given point of the segment 802C is created on the basis of the method (1) above. Since a Z-direction component of this normal 701I is in the positive direction, the target surface comparison section 62 can determine that the target surface 700C is located below the segment 802C.

In the situation of FIG. 8, the target surface comparison section 62 recognizes, with reference to an X-direction position, an area from a left end portion of the target surface 700A to the intersection point 803A as an area A, an area from the intersection point 803A to the intersection point 803B as an area B, and an area from the intersection point 803B to a right end of the target surface 700C as an area C. The areas A and C are areas where the current terrain profile 800 is located above the target surface 700, while the area B is an area where the current terrain profile 800 is located below the target surface 700.

<Use of Movable Range Information about Work Implement 1A>

The target surface comparison section 62 in the present embodiment limits a range of comparing the position relationship between the target surface 700 and the current terrain profile 800 using movable range information about the work implement 1A at a time of comparing the position relationship between the target surface 700 and the current terrain profile 800 as described with reference to FIG. 8. This respect will next be described with reference to FIGS. 9 and 10.

Figure 9:
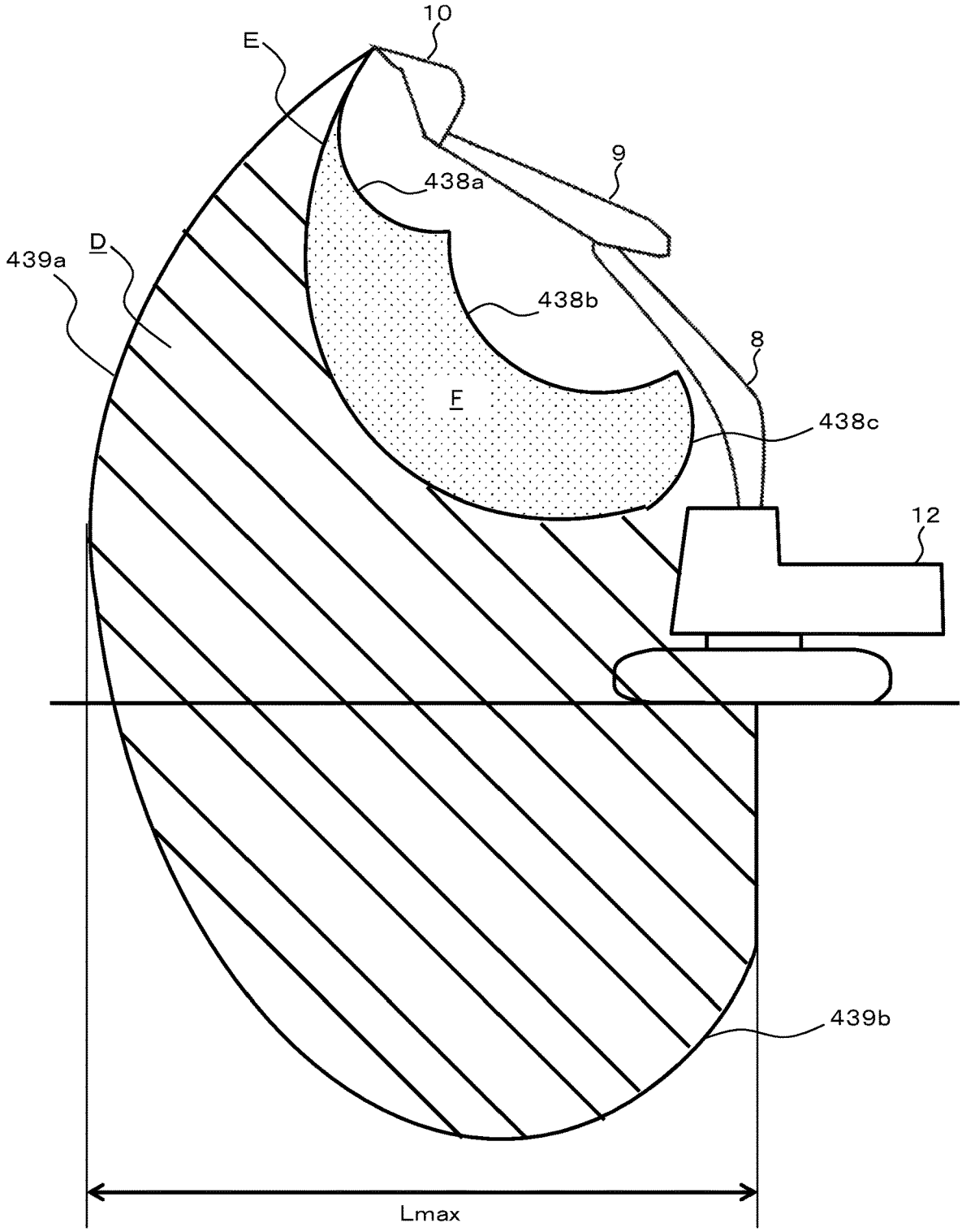
FIG. 9 is a diagram depicting a movable range, a workable range D, and an unworkable range F of a work implement 1A.

FIG. 9 depicts a movable range, a workable range D, and an unworkable range F of the work implement 1A. In FIG. 9, a shaded area denotes the workable range D, a dotted area denotes the unworkable range F, and an area of a combination of the two areas D and F is the movable range. These ranges are determined by dimensions of the boom 8, the arm 9, and the bucket 10, and strokes or angles of the boom cylinder 5, the arm cylinder 6, and the bucket cylinder 7.

In the present paper, it is assumed that the range in which the claw tip of the bucket 10 is movable is the "movable range" regardless of whether the work implement 1A can perform the excavation work. The movable range can be divided into a range in which the work implement 1A can perform the excavation work (workable range) and a range in which the work implement 1A is unable to perform the excavation work (unworkable range). The unworkable range is a range in which the work implement 1A is unable to perform the excavation work in a state in which the boom 8 is raised to a maximum degree (boom angle $\alpha$ is a minimum value). In a portion of the workable range adjoining the unworkable range, a range in which the work implement 1A can perform the excavation work in the state in which the boom 8 is raised to the maximum degree (boom angle $\alpha$ is the minimum value) (referred to as "boom-maximum-raising workable range") is present.

In the present embodiment, the "movable range" is specified as the area delimited by circular arcs 439*a*, 439*b*, 438*a*, 438*b*, and 438*c*. The circular arc 439*a* is a locus drawn by the tip end of the bucket 10 when the boom angle $\alpha$ is changed between the minimum value and a maximum value at postures of the arm 9 and the bucket 10 at which a length of the work implement 1A is maximum (maximum excavation radius) Lmax (such postures are sometimes referred to as "maximum reach postures"). It is noted that the bucket angle $\gamma$ at the maximum reach postures is sometimes referred to as "maximum reach angle." The circular arc 439*b* is a locus drawn by the tip end of the bucket 10 when the arm angle $\beta$ is changed between a minimum value and a maximum value in a state in which the boom angle $\alpha$ is the maximum value at the maximum reach postures. The circular arc 438*a* is a locus drawn by the tip end of the bucket 10 when a bucket cylinder length is changed between a minimum value and a maximum value in a state of setting the boom angle $\alpha$ to the minimum value and the arm angle $\beta$ to the minimum value. The circular arc 438*b* is a locus drawn by the tip end of the bucket 10 when the arm angle $\beta$ is changed between the minimum value and the maximum value in a state of setting the boom angle $\alpha$ to the minimum value and the bucket cylinder length to the maximum value. The circular arc 438*c* is a locus drawn by the tip end of the bucket 10 when the bucket cylinder length is changed between the minimum value and the maximum value in a state of setting the boom angle $\alpha$ to the minimum value and the arm angle $\beta$ to the maximum value.

In the present embodiment, the "movable range" is divided into the "workable range D" and the "unworkable range F" by a circular arc E. In other words, a boundary between these two ranges D and F is the circular arc E. In FIG. 6, an area above the circular arc E is the unworkable range F and an area below the circular arc is the workable range D. The circular arc E is a locus drawn by the tip end of the bucket 10 when the arm angle $\beta$ is changed between the minimum value and the maximum value with the boom angle $\alpha$ set to the minimum value and the bucket cylinder length set to the minimum value (bucket angle $\gamma$ to a negative maximum value), and is the range in which the work implement 1A can perform the excavation work in the state in which the boom 8 is raised to the maximum degree (boom angle $\alpha$ is the minimum value) ("boom-maximum-raising workable range" (first range)). The range F is specified as an area delimited by the circular arcs E, 438*a*, 438*b*, and 438*c*.

The "workable range D" is specified as an area delimited by the circular arcs 439*a* and 439*b* located relatively apart from the upper swing structure 12 and the circular arc E located relatively close to the upper swing structure 12.

Figure 10:
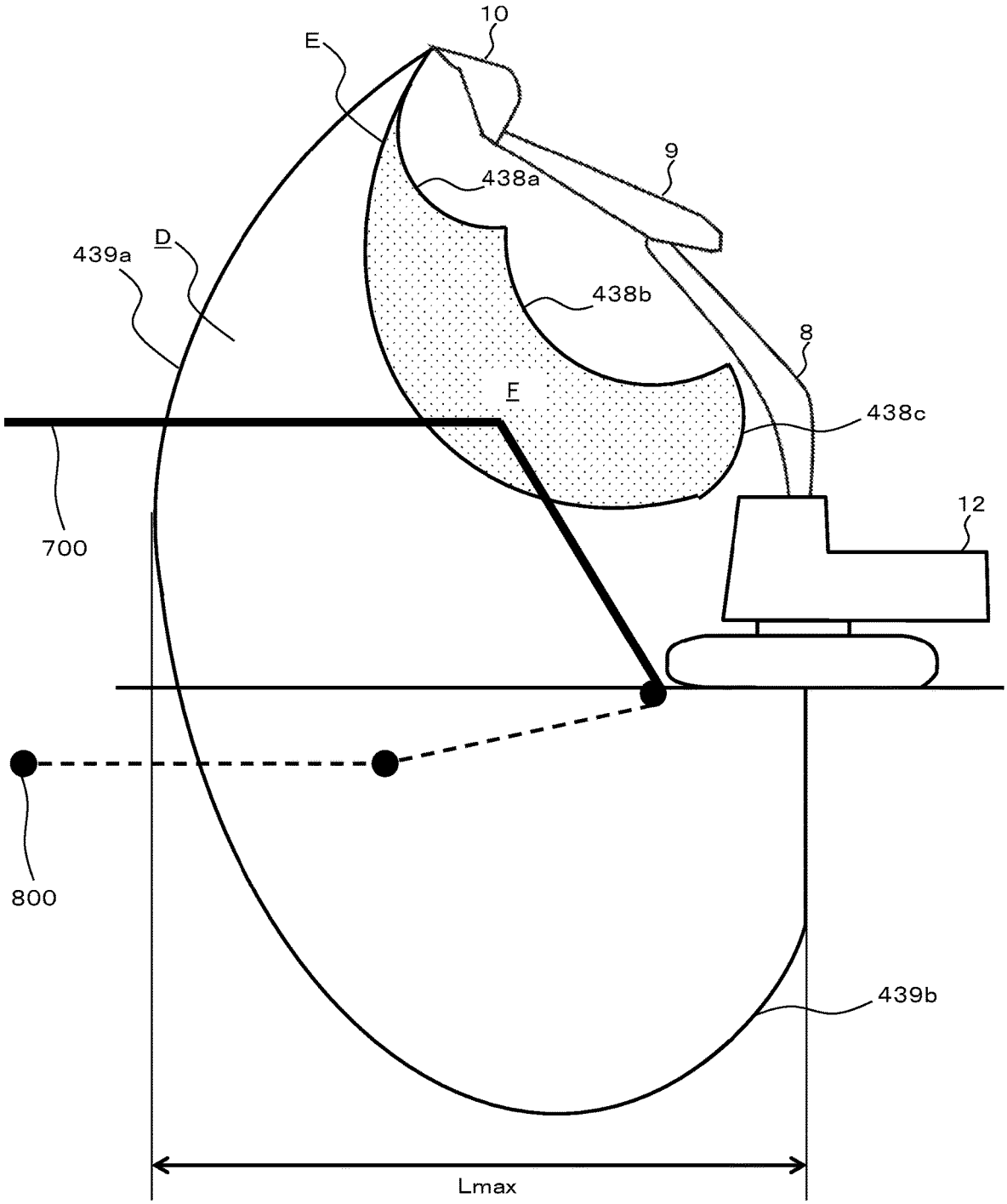
FIG. 10 is an explanatory diagram in a case of taking into account movable range information about the work implement 1A for determination of the vertical position relationship between the current terrain profile 800 and the target surface 700 by the target surface comparison section 62.

The target surface comparison section 62 in the present embodiment compares the position relationship between the target surface 700 and the current terrain profile 800 only within the workable range D defined as described above, which will also be obvious from FIG. 18 to be described later. In FIG. 10, for example, the target surface comparison section 62 compares the position relationship between the target surface 700 and the current terrain profile 800 only in parts within the workable range D. In that case, a computing load of the controller 40 can be reduced since the target surface comparison section 62 does not compare the position relationship between the current terrain profile 800 and the target surface 700 in ranges that are not reached by the work implement 1A.

It is noted that the target surface comparison section 62 may determine the vertical position relationship between the target surface 700 and the current terrain profile 800 using the movable range as an alternative to the workable range D. Furthermore, use of the movable range information about the work implement 1A is not always essential at the time of determination of the vertical position relationship between the target surface 700 and the current terrain profile 800, and the target surface comparison section 62 may compare the position of the target surface 700 with the position of the current terrain profile 800 in overlapping ranges of ranges of acquiring the target surface 700 and the current terrain profile 800.

<Notification Content Change Flag>

Figure 18:
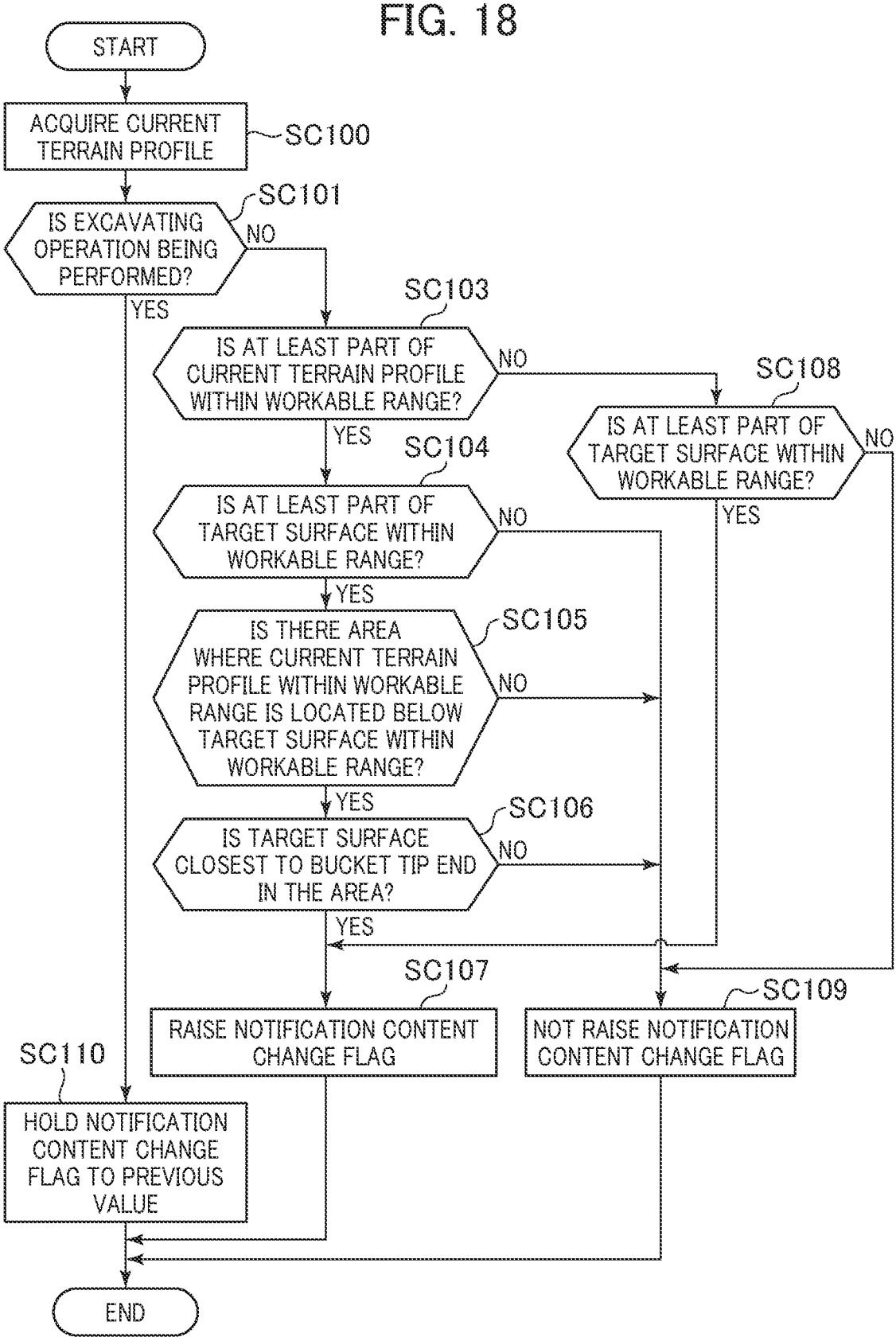
FIG. 18 is a flowchart related to the notification content change flag by the target surface comparison section 62.

The output process for outputting the notification content change flag by the target surface comparison section 62 will next be described with reference to FIG. 18. FIG. 18 is a flowchart related to the notification content change flag by the target surface comparison section 62.

First, in Step SC100, the target surface comparison section 62 acquires the position information about the current terrain profile 800 around the hydraulic excavator 1 from the current terrain profile acquisition device 96.

Next, in Step SC101, the target surface comparison section 62 determines whether an excavating operation is being performed by the operator. By performing this determination, the notification content change flag does not change during excavation and notification content is not changed over during the excavation; thus, it is possible to prevent the operator from having a feeling of strangeness. Whether the excavating operation is being performed can be determined on the basis of cylinder velocities and a velocity of the tip end portion of the bucket 10 computed by the actuator control section 81. Alternatively, the target surface comparison section 62 may determine whether the excavating operation is being performed by the arm 9 or the bucket 10 on the basis of the information from the operator's operation sensor 52*a*. It is noted that a flow may be configured such that the target surface comparison section 62 omits determination in Step SC101 and goes to Step SC103 after Step S100.

In a case of determining in Step SC101 that the excavating operation is not being performed, the target surface comparison section 62 goes to Step SC103. Conversely, in a case of determining that the excavating operation is being performed, the target surface comparison section 62 goes to Step SC110 and holds the notification content change flag to a previous value without performing a comparison process.

In Step SC103, the target surface comparison section 62 determines whether at least part of the current terrain profile 800 is present within the workable range D. In a case of determining that at least part of the current terrain profile 800 is present within the workable range D, the target surface comparison section 62 goes to Step SC104. In a case of determining that no part of the current terrain profile 800 is present within the workable range D, the target surface comparison section 62 goes to Step SC108.

In Step SC104, the target surface comparison section 62 determines whether at least part of the target surface 700 is present within the workable range D. In a case of determining that at least part of the target surface 700 is present within the workable range D, the target surface comparison section 62 goes to Step SC105. In a case of determining that no part of the target surface 700 is present within the workable range D, the target surface comparison section 62 goes to Step SC109.

In Step SC105, the target surface comparison section 62 determines whether an area where the current terrain profile 800 is located below the target surface 700 is present with respect to the current terrain profile 800 and the target surface 700 present within the workable range D. The determination of the vertical position relationship between the current terrain profile 800 and the target surface 700 is based on the methods described with reference to FIG. 8. In a case of determining that the area where the current terrain profile 800 is located below the target surface 700 is present, the target surface comparison section 62 goes to Step SC106. Otherwise (in a case in which only an area where the current terrain profile 800 is located above the target surface 700 is present), the target surface comparison section 62 goes to Step S109.

In Step SC106, the target surface comparison section 62 determines whether the target surface 700 closest to the tip end portion of the bucket 10 (that is, work implement 1A) is present in the area where it is determined in Step SC105 that the current terrain profile 800 is located below the target surface 700. In a case of determining that the target surface 700 closest to the bucket 10 is located below the current terrain profile 800, the target surface comparison section 62 goes to Step SC107. Otherwise (in a case in which the target surface 700 closest to the bucket is not located below the current terrain profile 800), the target surface comparison section 62 goes to Step SC109.

In Step SC107, the target surface comparison section 62 determines that the current terrain profile 800 is located below the target surface 700 (that is, filling work is under way), raises the notification content change flag, and outputs a result of the notification content change flag to the notification control section 374, the actuator control section 81, and the like. While a case in which the notification content change flag is raised has a total of two patterns in which the target surface comparison section 62 goes through either Step SC106 or SC108, it is assumed that an indication whether the target surface comparison section 62 has gone through Step SC106 or SC108 is added to information about the notification content change flag output by the target surface comparison section 62.

In Step SC109, the target surface comparison section 62 does not raise the notification content change flag (or lowers the notification content change flag in a case where the notification content change flag has already been raised), and outputs a result of not raising the notification content change flag to the notification control section 374, the actuator control section 81, and the like.

Meanwhile, in Step SC108, the target surface comparison section 62 determines whether at least part of the target surface 700 is present within the workable range D. In a case in which a determination result is YES, the target surface comparison section 62 goes to Step SC107. In a case in which the determination result is NO, the target surface comparison section 62 goes to Step SC109.

In a case of performing a process based on the flow of FIG. 18 in the example of FIG. 8, the notification content change flag is raised when the current terrain profile 800 is below the target surface 700, that is, in the area B, and the notification content change flag is lowered in the remaining areas A and C where the current terrain profile 800 is above the target surface 700.

<MG Target Surface Change Flag>

Figure 19:
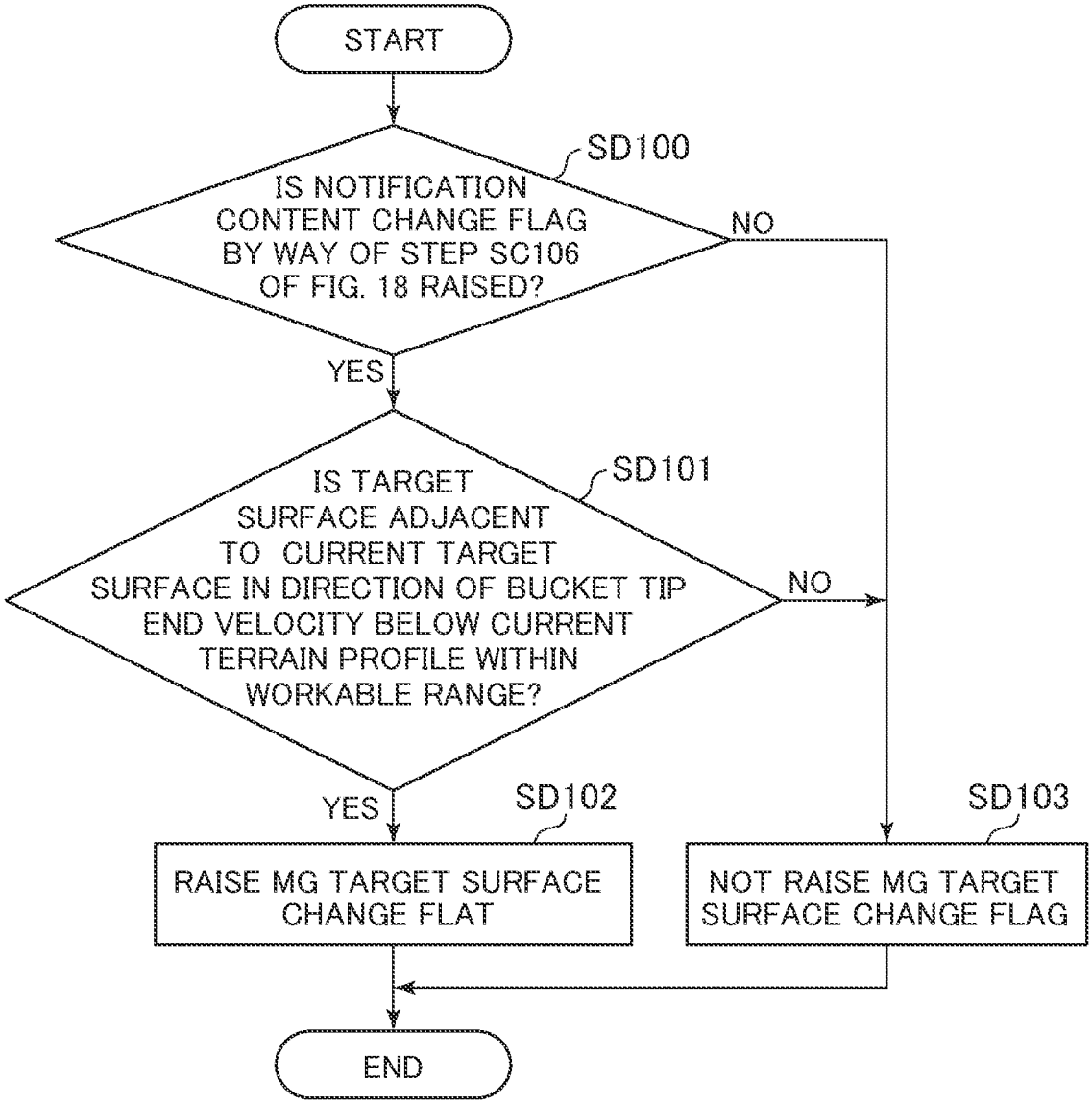
FIG. 19 is a flowchart related to an MG target surface change flag by the target surface comparison section 62.

The output process for outputting the MG target surface change flag by the target surface comparison section 62 will next be described with reference to FIG. 19. FIG. 19 is a flowchart related to the MG target surface change flag by the target surface comparison section 62.

First, in Step SD100, the target surface comparison section 62 determines whether the notification content change flag for which the target surface comparison section 62 goes through Step SC106 in the flowchart of FIG. 18 is raised. In a case of determining that this flag is raised, the target surface comparison section 62 goes to Step SD101; otherwise, the target surface comparison section 62 goes to Step SD103.

In Step SD101, the target surface comparison section 62 determines whether the target surface present in a direction of a velocity vector of the tip end of the bucket 10 (that is, motion direction of the bucket 10) out of the two target surfaces adjacent to the target surface closest to the bucket 10 present within the workable range D is located below the current terrain profile 800. The target surface to be determined will be rephrased herein by another expression. In a case in which the velocity vector of the bucket tip end is toward the machine body 1B, the target surface closer to the machine body 1B out of the two target surfaces adjacent to the target surface closest to the bucket 10 is to be determined. In a case in which the velocity vector of the bucket tip end is in a direction in which the velocity vector is apart from the machine body 1B, the target surface farther from the machine body out of the two target surfaces is to be determined. In a case of determining that the target surface to be determined is located below the current terrain profile 800, the target surface comparison section 62 goes to Step SD102; otherwise, the target surface comparison section 62 goes to Step SD103.

In Step SD102, since the target surface in the motion direction of the bucket 10 (target surface that possibly becomes the target surface closest to the bucket 10 soon) is located below the current terrain profile 800, the target surface comparison section 62 determines to set the target surface as an MG target in advance and to notify the operator of a warning related to the distance between the target surface and the bucket 10, raises the MG target surface change flag, and outputs a result of raising the MG target surface change flag to the notification control section 374 and the like.

In Step SD103, the target surface comparison section 62 does not raise the MG target surface change flag (or lowers the MG target surface change flag in a case where the MG target surface change flag has already been raised), and outputs a result of not raising the MG target surface change flag to the notification control section 374 and the like.

In FIG. 8, for example, in a case of determining that the bucket 10 is moving from the area B to the area C, the target surface comparison section 62 raises the MG target surface change flag.

In this way, raising the MG target surface change flag and making changes the target surface as the MG target make it possible to carry out more appropriate MG. In other words, setting, as the MG target, the target surface 700 for which there is a probability that the current terrain profile 800 is excessively excavated if the bucket 10 enters the corresponding area instead of the target surface 700 for which there is no probability that the current terrain profile 800 is excessively excavated even if the bucket 10 enters the corresponding area enables the operator to perform the appropriate MG.

Figure 20:
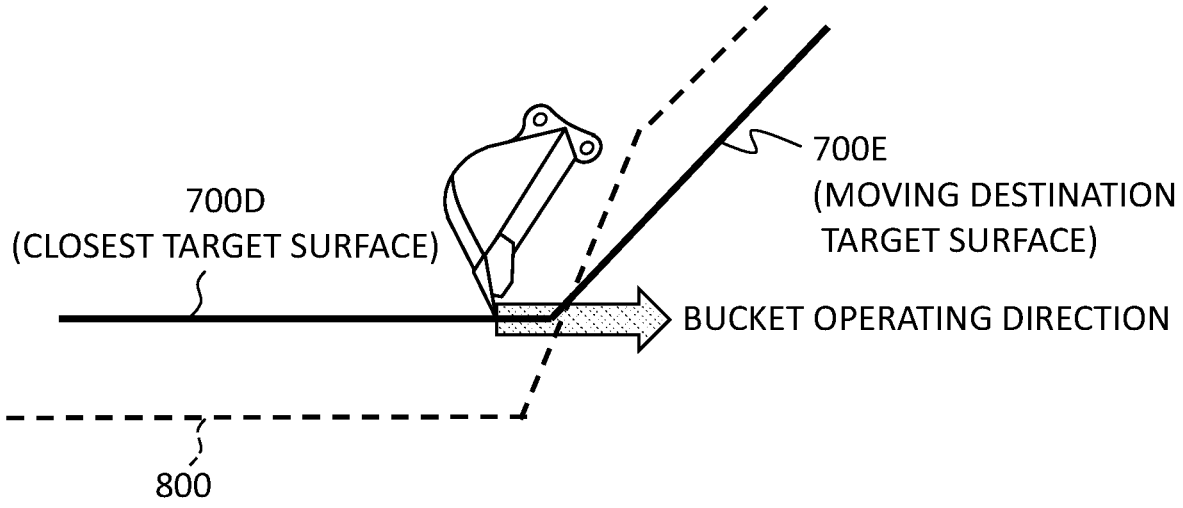
FIG. 20 is an explanatory diagram of a closest target surface and a moving destination target surface.

Specifically, as depicted in FIG. 20, in a case of conventional MG, the MG is carried out in response to the distance between the bucket 10 and the target surface; thus, the target surface closest to the bucket 10 (sometimes referred herein to as "closest target surface") 700D is set as the MG target. In the present embodiment, instead of the target surface 700D closest to the bucket 10, the target surface adjacent to the target surface 700D in the motion direction of the bucket 10 (sometimes referred herein to as "moving destination target surface") 700E is set as the MG target.

<Notification Control Section 374>

Figure 11:
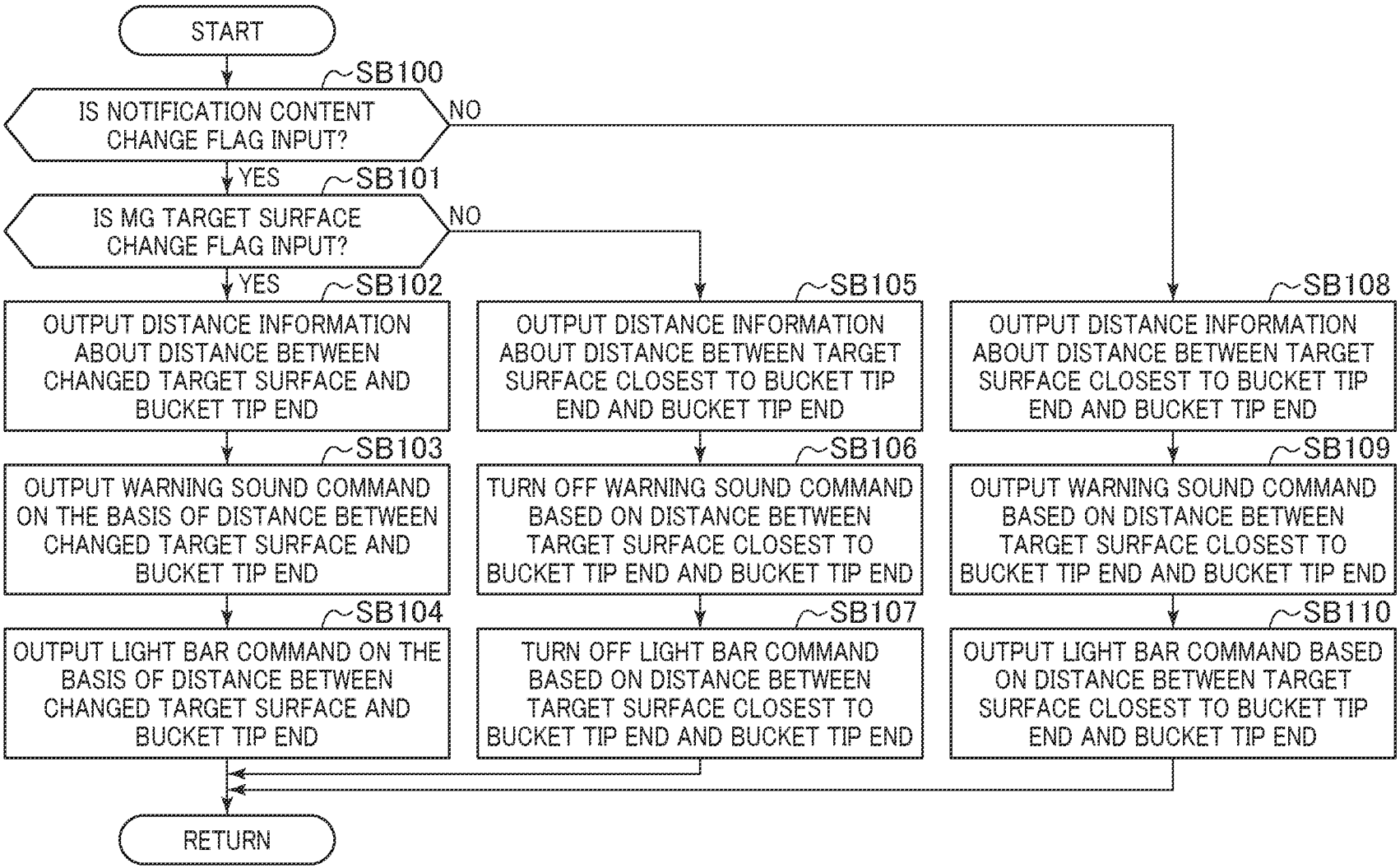
FIG. 11 is a flowchart depicting control over notification content by a notification control section 374.

Details of a process performed by the notification control section 374 will next be described. FIG. 11 depicts a flow of control over notification content by the notification control section 374. The notification control section 374 in the present embodiment exercises control as to whether to notify, on the basis of a distance between the predetermined target surface as the MG target and the bucket 10 (target surface distance), the operator of a warning related to the target surface distance via the notification device 53. In addition, even in a case of determining that a situation is one in which the operator should be notified of the warning only on the basis of the target surface distance, the notification control section 374 executes a process for changing the content of the operation support information including the warning depending on presence/absence of the two flags (notification content change flag and MG target surface change flag) that are the determination results of the target surface comparison section 62.

First, in Step SB100, the notification control section 374 determines whether the notification content change flag is input from the target surface comparison section 62. In a case in which the notification content change flag is input, the notification control section 374 goes to Step SB101. In a case in which the notification content change flag is not input, the notification control section 374 goes to Step SB108.

In Step SB101, the notification control section 374 determines whether the MG target surface change flag is input from the target surface comparison section 62. In a case in which the MG target surface change flag is input, the notification control section 374 goes to Step SB102. In a case in which the MG target surface change flag is not input, the notification control section 374 goes to Step SB105.

Next, the process will be described with respect to three cases in which the notification control section 374 goes to Steps SB102, 105, and 108.

(A) Step SB102

A situation in which the notification control section 374 goes to Step SB102 corresponds to a case in which the target surface closest to the bucket 10 (closest target surface) 700 is located above the current terrain profile 800 (that is, a current circumstance is a circumstance in which filling work is possibly performed) but in which the target surface adjacent to the closest target surface in the motion direction of the bucket 10 (moving destination target surface) is located below the current terrain profile (that is, a case in which it is possibly predicted that the excavation work starts soon). In this case, it is assumed that the notification control section 374 designates the target surface as the MG target as the moving destination target surface and notifies the operator of the warning related to the distance between the moving destination target surface and the bucket 10 via the notification device 53. Specifically, the notification control section 374 executes a warning process in Steps SB102, 103, and 104.

In other words, in Step SB102, the notification control section 374 outputs data about a distance between the moving destination target surface 700 and the claw tip of the bucket 10 designated by the target surface comparison section 62, among the distances between the target surfaces 700 and the claw tip of the bucket 10 output from the target surface computing section 43*c*, to the notification device 53 (display device) to display the data on the screen of the notification device 53.

In next Step SB103, the notification control section 374 outputs a warning sound command based on the distance between the moving destination target surface 700 and the claw tip of the bucket 10 designated by the target surface comparison section 62, among the distances between the target surfaces 700 and the claw tip of the bucket 10 output from the target surface computing section 43*c*, to the notification device 53 (audio output device) to produce a warning sound. It is to be noted, however, that a threshold of the distance for which the warning sound is output is determined, and the notification control section 374 is configured to output the warning sound in a case in which the distance between the target surface as the MC target and the bucket 10 is below the threshold.

Furthermore, in Step SB104, the notification control section 374 outputs a light bar command based on the distance between the moving destination target surface 700 and the claw tip of the bucket 10 designated by the target surface comparison section 62, among the distances between the target surfaces 700 and the claw tip of the bucket 10 output from the target surface computing section 43*c*, to the notification device 53 (display device).

Figure 14:
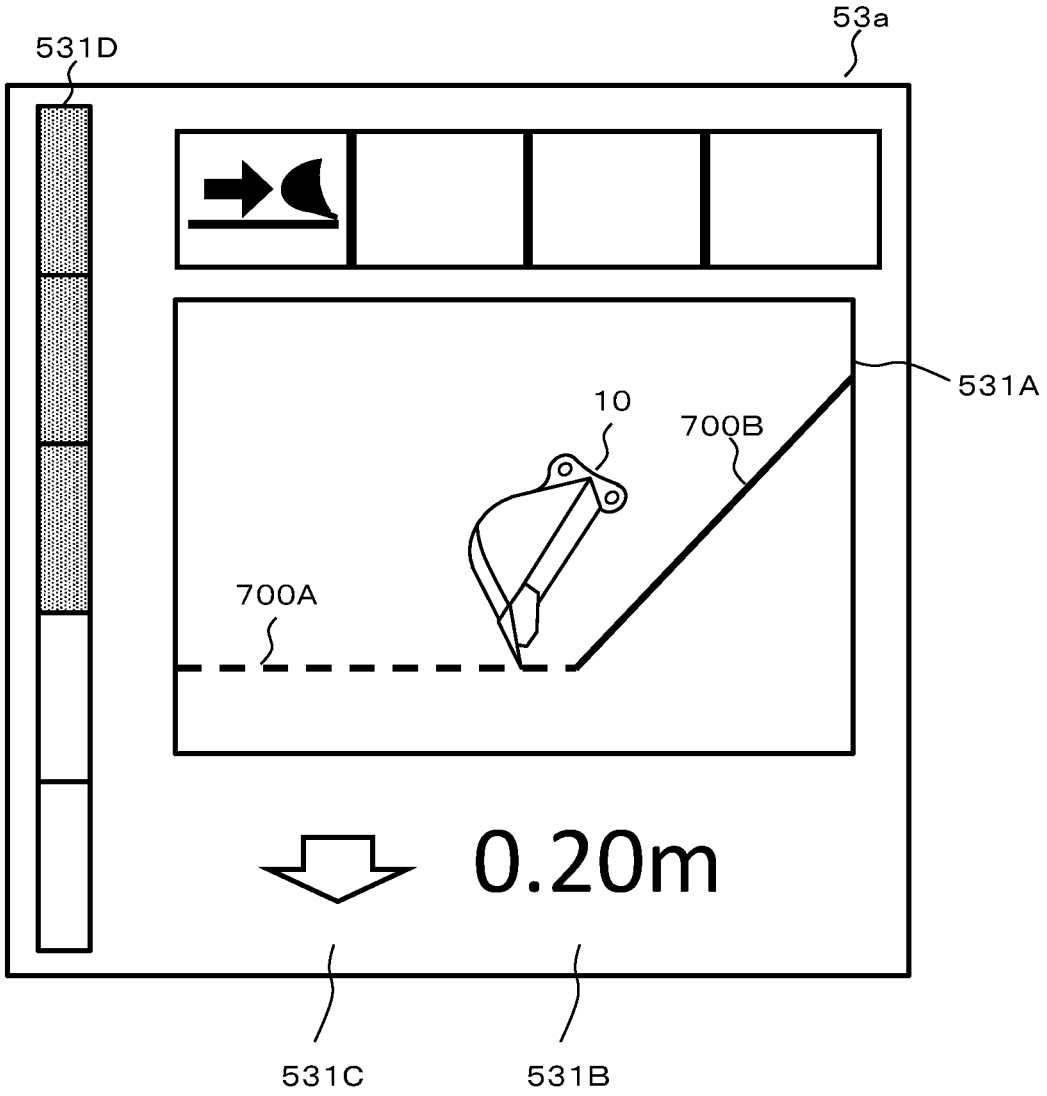
FIG. 14 is an example of a display screen of the notification device 53 in a case in which the notification control section 374 goes to Step SB102.

FIG. 14 is an example of a display screen 53*a* of the notification device 53 in the case in which the notification control section 374 goes to Step SB102. On the display screen 53*a*, a symbol display section 531A in which the position relationship between the bucket 10 and the target surface 700 is displayed by an image, a numerical value display section 531B in which the distance from the bucket 10 to the target surface as the MG target is displayed by a numerical value, an arrow display section 531C in which a direction in which the target surface as the MG target is located with reference to the bucket 10 is displayed by an arrow, and a light bar display section 531D in which the distance from the bucket 10 to the target surface as the MG target is visually displayed by a light bar are provided.

In the symbol display section 531A, the target surface 700B (moving destination target surface) for which there is a probability that the current terrain profile is excessively excavated when the bucket 10 enters the area is displayed by a solid line. On the other hand, the target surface 700A (closest target surface) for which there is no probability that the current terrain profile is excessively excavated even when the bucket 10 enters the area is displayed by a broken line.

In the numerical value display section 531B, the distance between the target surface 700B and the bucket 10 output in Step SB102 (0.20 m) is displayed.

Types of the arrow displayed in the arrow display section 531C include an upward arrow and a downward arrow, the downward arrow indicating that the target surface as the MG target is located below the bucket claw tip, and the upward arrow indicating that the target surface as the MG target is located above the bucket claw tip. In an example of FIG. 14, the arrow is downward, indicating that the target surface 700B as the MG target is below the claw tip.

The light bar display section 531D is lit up in response to the distance between the target surface 700B and the bucket 10. The light bar of FIG. 14 is configured with five segments that are disposed in series in a longitudinal direction and that can be lit up, and the upper three segments that are being lit up are dotted in the figure. In the present embodiment, in a case in which the claw tip is present at a distance of ±0.05 m from the target surface as the MG target, only the central segment is lit up. In a case in which the claw tip is present at a distance of 0.05 to 0.10 m from the target surface as the MG target, two segments, i.e. the central segment and the upper segment of the central segment, are lit up, and in a case in which the claw tip is present at a distance exceeding 0.10 m from the target surface as the MG target, three segments, i.e. the central segment and the two upper segments of the central segment, are lit up. Likewise, in a case in which the claw tip is present at a distance of −0.05 to −0.10 m, two segments, i.e. the central segment and the lower segment of the central segment, are lit up, and in a case in which the claw tip is present at a distance below −0.10 m, three segments, i.e. the central segment and the two lower segments of the central segment, are lit up. In the example of FIG. 14, the distance to the target surface as the MG target is +0.20 m; thus, the three upper segments are lit up on the basis of the light bar command output in Step SB104 of FIG. 11.

Figure 15:
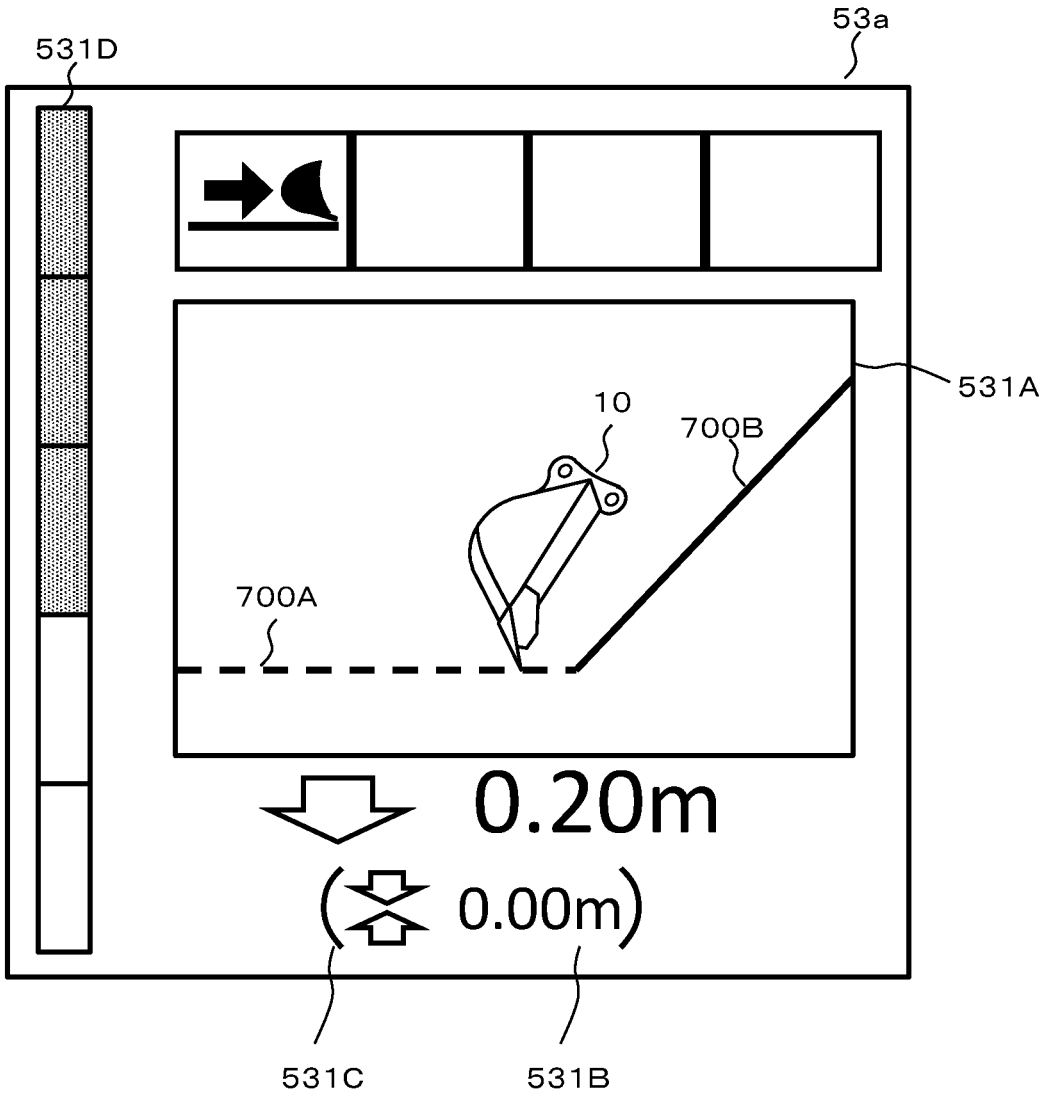
FIG. 15 is an example of a display screen of the notification device 53 in the case in which the notification control section 374 goes to Step SB102.

FIG. 15 depicts a modification of the display screen depicted in FIG. 14. Description of common parts will be omitted. FIG. 15 depicts an example of modifying the numerical value display section 531B and the arrow display section 531C. Objects indicated in parentheses for the numerical value display section 531B and the arrow display section 531C are a numerical value and arrows corresponding to the target surface 700A (closest target surface) that is not the MG target, and displayed smaller than the numerical value and the arrow corresponding to the target surface 700B that is the MG target. In this way, displaying the position information about the bucket 10 relative to the target surface 700A that is not the MG target in addition to the position information about the bucket 10 relative to the target surface 700B that is the MG object enables the operator to grasp the position information about the bucket 10 relative to the two target surfaces 700A and 700B.

(B) Step SB105

A typical situation in which the notification control section 374 goes to Step SB105 corresponds to a case in which the target surface closest to the bucket 10 (closest target surface) 700 is located above the current terrain profile 800 (that is, a current circumstance is a circumstance in which filling work is possibly performed) and in which the target surface adjacent to the closest target surface in the motion direction of the bucket 10 (moving destination target surface) is also located above the current terrain profile (that is, a case in which the filling work is also predicted in the moving destination). This situation also corresponds to a case in which the closest target surface is located above the current terrain profile but in which the moving destination target surface is not present. In such a case, it is assumed that the notification control section 374 designates the target surface as the MG target as the closest target surface and notifies the operator of the numerical value of the distance between the target surface as the MG target (closest target surface) and the bucket 10 via the notification device 53, but suspends notification related to the warning sound and the light bar. Specifically, the notification control section 374 executes a warning process in Steps SB105, 106, and 107.

In other words, in Step SB105, the notification control section 374 outputs data about the distance between the closest target surface 700 closest to the bucket 10 and the claw tip of the bucket 10, among the distances between the target surfaces 700 and the claw tip of the bucket 10 output from the target surface computing section 43*c*, to the notification device 53 (display device) to display the data on the screen of the notification device 53.

In next Step SB106, the notification control section 374 outputs an indication to turn off the warning sound command based on the distance between the closest target surface 700 and the claw tip of the bucket 10 to the notification device 53. This suspends production of the warning sound from the notification device 53 (audio output device).

In Step SB107, the notification control section 374 outputs an indication to turn off the light bar command based on the distance between the closest target surface 700 and the claw tip of the bucket 10 to the notification device 53. This suspends lighting-up of all the segments in the light bar on the notification device 53 (display device).

Figure 13:
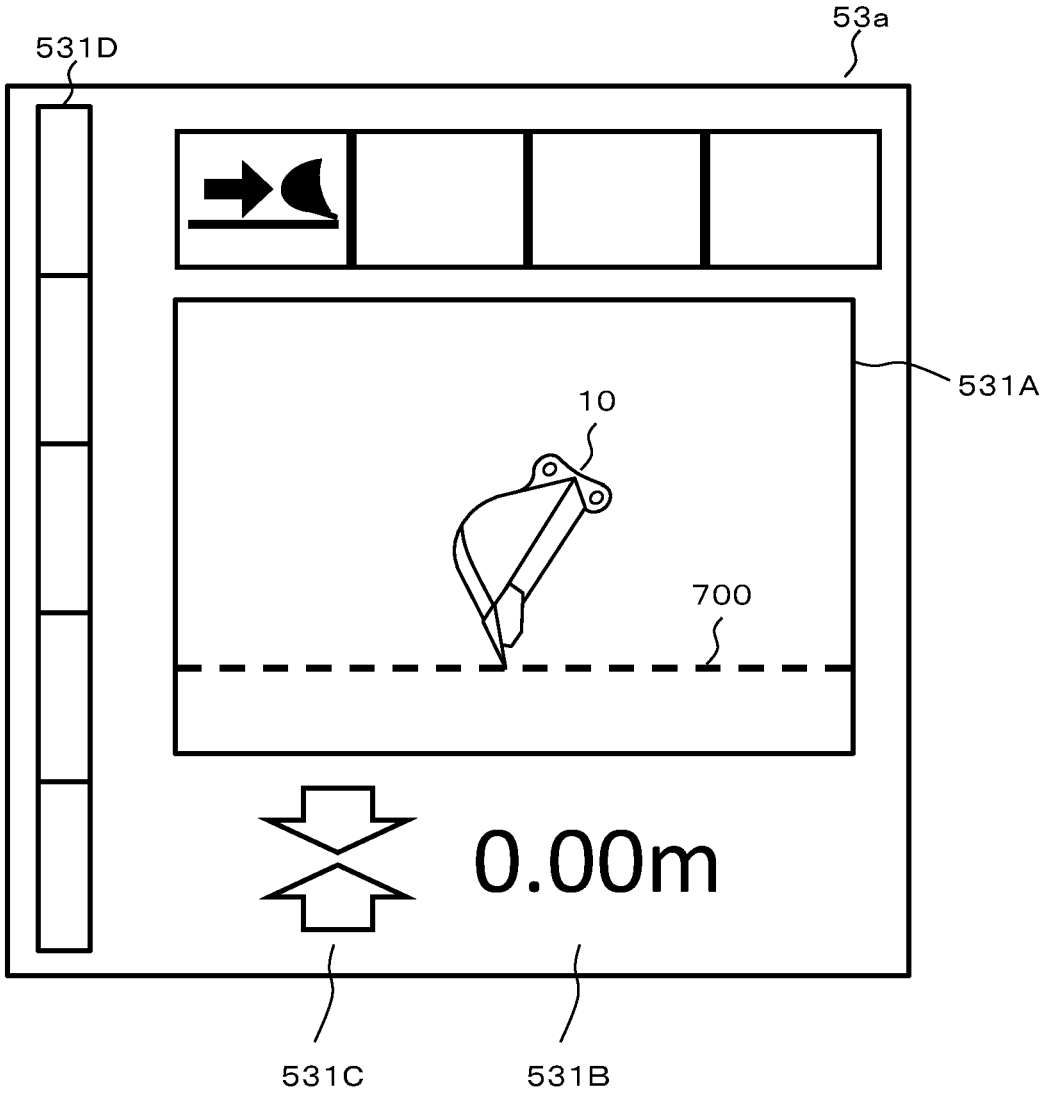
FIG. 13 is an example of a display screen of the notification device 53 in a case in which the notification control section 374 goes to Step SB105.

FIG. 13 is an example of the display screen 53*a* of the notification device 53 in a case in which the notification control section 374 goes to Step SB105. At this time, because of the situation in which the current terrain profile is below the target surface 700, there is no probability that the current terrain profile is excessively excavated even if the bucket 10 enters the area below the target surface 700. For that reason, a line indicating the target surface 700 is displayed as a broken line in the symbol display section 531A. In addition, none of the segments is lit up in the light bar display section 531D and no warning sound is output from the notification device 53 (audio output device).

(C) Step SB108

A typical situation in which the notification control section 374 goes to Step SB108 corresponds to a case in which the closest target surface 700 closest to the bucket 10 is located below the current terrain profile 800 (that is, a current circumstance is an ordinary circumstance in which the excavation work is possibly performed). In this case, it is assumed that the notification control section 374 designates the target surface as the MG target as the closest target surface and notifies the operator of the warning related to the distance between the closest target surface and the bucket 10 via the notification device 53. Specifically, the notification control section 374 executes a warning process in Steps SB108, 109, and 110.

In other words, in Step SB108, the notification control section 374 outputs data about the distance between the closest target surface 700 closest to the bucket 10 and the claw tip of the bucket 10, among the distances between the target surfaces 700 and the claw tip of the bucket 10 output from the target surface computing section 43*c*, to the notification device 53 (display device) to display the data on the screen of the notification device 53.

In next Step SB109, the notification control section 374 outputs the warning sound command based on the distance between the closest target surface 700 and the claw tip of the bucket 10, among the distances between the target surfaces 700 and the claw tip of the bucket 10 output from the target surface computing section 43*c*, to the notification device 53 (audio output device) to produce the warning sound. The threshold of the distance for which the warning sound is output in this case is assumed to be the same as that in Step SB103.

Furthermore, in Step SB110, the notification control section 374 outputs the light bar command based on the distance between the closest target surface 700 and the claw tip of the bucket 10, among the distances between the target surfaces 700 and the claw tip of the bucket 10 output from the target surface computing section 43*c*, to the notification device 53 (display device).

Figure 12:
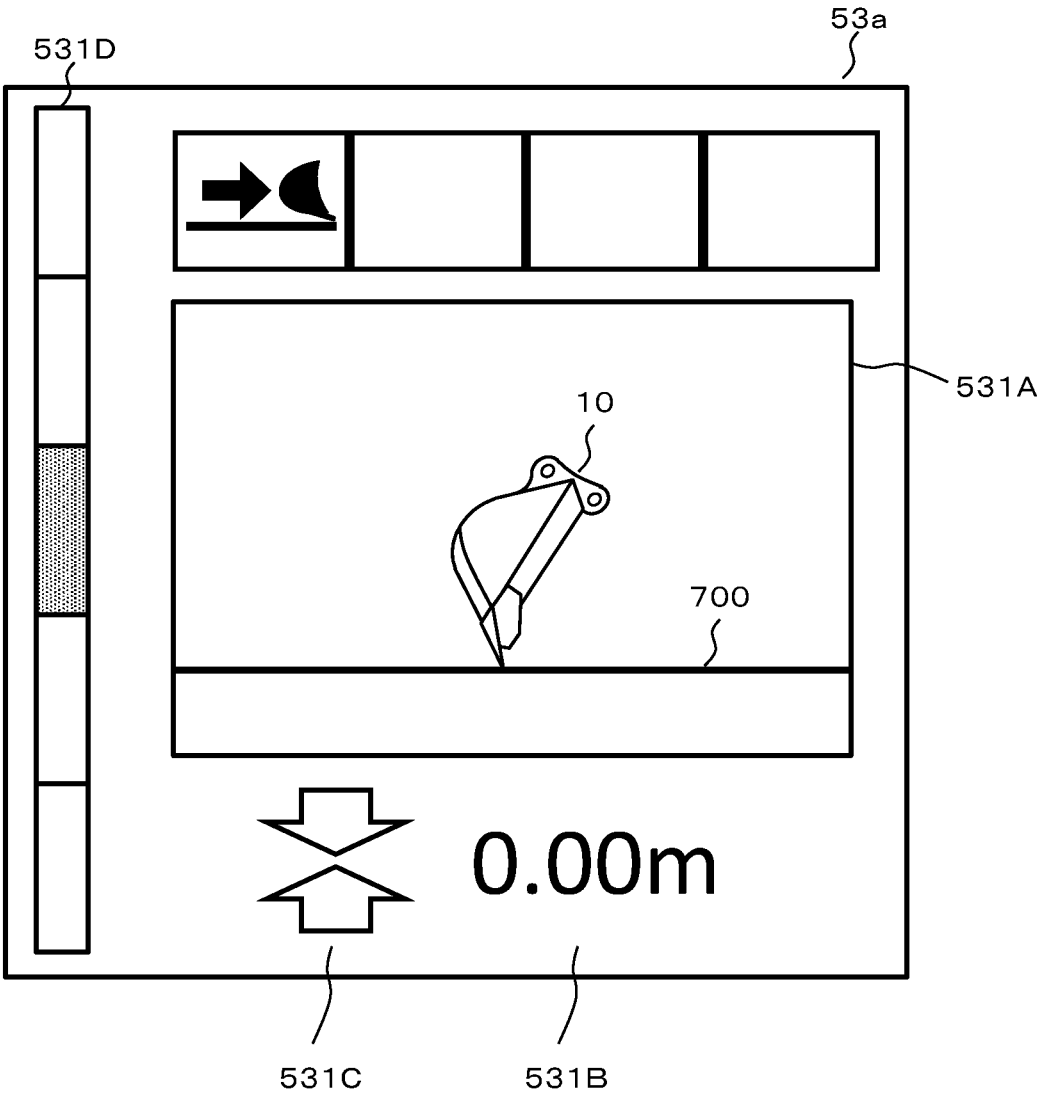
FIG. 12 is an example of a display screen of a notification device 53 in a case in which the notification control section 374 goes to Step SB108.

FIG. 12 is an example of the display screen 53*a* of the notification device 53 in a case in which the notification control section 374 goes to Step SB108. In the symbol display section 531A, the target surface 700 for which there is a probability that the current terrain profile is excessively excavated when the bucket 10 enters the area is displayed by a solid line. Furthermore, the distance between the closest target surface 700 and the bucket 10 (0.00 m) is displayed in the numerical value display section 531B. In the example of this drawing, since the distance between the bucket 10 and the target surface 700 is zero, both upward and downward arrows are displayed in the arrow display section 531C. Moreover, as for the light bar display section 531D, since the distance between the bucket 10 and the target surface 700 is zero, only the central segment is lit up.

<Actuator Control Section 81>

Details of a process performed by the actuator control section 81 will next be described. The actuator control section 81 in the present embodiment executes, as the MC, a motion to prevent entry of the bucket 10 into the target surface 700 by boom raising control. FIG. 16 depicts a flow of the boom raising control by this actuator control section 81. FIG. 16 is a flowchart of the MC executed by the actuator control section 81, and the process is started upon operation of the operation devices 45*a*, 45*b*, and 46*a* by an operator.

In S410, the actuator control section 81 computes motion velocities (cylinder velocities) of the hydraulic cylinders 5, 6, and 7 on the basis of the operation amounts computed by the operation amount computing section 43*a*.

In S420, the actuator control section 81 computes a velocity vector B of the bucket tip end (claw tip) by an operator's operation on the basis of the motion velocities of the hydraulic cylinders 5, 6, and 7 computed in S410 and the posture of the work implement 1A computed by the posture computing section 43*b*.

In S430, the actuator control section 81 calculates a distance D (refer to FIG. 4) from the bucket tip end to the target surface 700 to be controlled (which corresponds to the closest target surface in many cases) from the position (coordinates) of the claw tip of the bucket 10 computed by the posture computing section 43*b* and a distance of a straight line containing the target surface 700 and stored in the ROM 93. Next, the actuator control section 81 determines whether the notification content change flag is raised on the basis of an input signal from the target surface comparison section 62. In a case in which the notification content change flag is lowered (that is, in a case of an excavation work in a state in which the target surface 700 is located below the current terrain profile 800), the actuator control section 81 calculates a limit value "ay" for a vertical component to the target surface 700 in the velocity vector of the bucket tip end on the basis of the distance D and a graph of FIG. 17. The limit value "ay" of FIG. 17 is set per distance D and set to increase in proportion to a decrease of the distance D. On the other hand, in a case in which the notification content change flag is raised (that is, in a case of a filling work in a state in which the target surface 700 is located above the current terrain profile 800), the actuator control section 81 calculates the limit value "ay" on the basis of the distance D and a graph of FIG. 21. In the graph of FIG. 21, the limit value "ay" is set to be smaller than that in the graph of FIG. 17 for all distances D. Furthermore, in the present embodiment, an absolute value of the limit value "ay" is set sufficiently large, and is set larger than a possible absolute value of a vertical component "by" to the target surface 700 in the velocity vector B of the bucket tip end.

In S440, the actuator control section 81 acquires the vertical component "by" to the target surface 700 in the velocity vector B of the bucket tip end by the operator's operation calculated in S420.

In S450, the actuator control section 81 determines whether the limit value "ay" calculated in S430 is equal to or greater than zero. It is noted that xy coordinates are set as depicted in upper right part of FIG. 16. In the xy coordinates, an x-axis is positive in a rightward direction in FIG. 16 parallel to the target surface 700 and a y-axis is positive in an upward direction therein vertical to the target surface 700. In legends in FIG. 16, the vertical component "by" and the limit value "ay" are negative and a horizontal component "bx," a horizontal component "cx," and a vertical component "cy" are positive. As is clear from FIG. 17, the limit value "ay" that is zero corresponds to a case in which the distance D is zero, that is, the claw tip is located on the target surface 700, the limit value "ay" that is positive corresponds to a case in which the distance D is negative, that is, the claw tip is located below the target surface 700, and the limit value "ay" that is negative corresponds to a case in which the distance D is positive, that is, the claw tip is located above the target surface 700. The actuator control section 81 goes to S460 in a case of determining in S450 that the limit value "ay" is equal to or greater than zero (that is, the claw tip is located on or below the target surface 700), and the actuator control section 81 goes to S480 in a case in which the limit value "ay" is smaller than zero.

In S460, the actuator control section 81 determines whether the vertical component "by" in the velocity vector B of the claw tip by the operator's operation is equal to or greater than zero. A case in which the "by" is positive indicates that the vertical component "by" in the velocity vector B is upward, and a case in which the "by" is negative indicates that the vertical component "by" in the velocity vector B is downward. The actuator control section 81 goes to S470 in a case of determining in S460 that the vertical component "by" is equal to or greater than zero (that is, the vertical component "by" is upward), and goes to S500 in a case in which the vertical component "by" is smaller than zero.

In S470, the actuator control section 81 compares an absolute value of the limit value "ay" with an absolute value of the vertical component "by," and goes to S500 in a case in which the absolute value of the limit value "ay" is equal to or greater than that of the vertical component "by." On the other hand, the actuator control section 81 goes to S530 in a case in which the absolute value of the limit value "ay" is smaller than that of the vertical component "by."

In S500, the actuator control section 81 selects "cy=ay−by" as an equation for calculating the vertical component cy to the target surface 700 in a velocity vector C of the bucket tip end to be generated by a motion of the boom 8 under machine control, and calculates the vertical component "cy" on the basis of the equation, the limit value "ay" in S430, and the vertical component "by" in S440. The actuator control section 81 then calculates the velocity vector C capable of outputting the calculated vertical component "cy" and sets a horizontal component in the velocity vector C to the cx (S510).

In S520, the actuator control section 81 calculates a target velocity vector T. Assuming that a vertical component to the target surface 700 in the target velocity vector T is "ty" and a horizontal component therein is "tx," the vertical component "ty" and the horizontal component "tx" can be expressed as "ty=by +cy, tx=bx+cx," respectively. By substituting the equation (cy=ay−by) in S500 into the "ty=by +cy, tx=bx+cx," the target velocity vector T is eventually expressed as "ty=ay, tx=bx+cx." In other words, the vertical component "ty" in the target velocity vector in a case of going to S520 is limited by the limit value "ay" and forced boom raising under machine control is actuated.

In S480, the actuator control section 81 determines whether the vertical component "by" in the velocity vector B of the claw tip by the operator's operation is equal to or greater than zero. The actuator control section 81 goes to S530 in a case of determining in S480 that the vertical component "by" is equal to or greater than zero (that is, the vertical component "by" is upward), and goes to S490 in a case in which the vertical component "by" is smaller than zero.

In S490, the actuator control section 81 compares the absolute value of the limit value "ay" with the absolute value of the vertical component "by," and goes to S530 in the case in which the absolute value of the limit value "ay" is equal to or greater than that of the vertical component "by." On the other hand, the actuator control section 81 goes to S500 in a case in which the absolute value of the limit value "ay" is smaller than that of the vertical component "by."

In a case of going to S530, a front device control section 81*d* sets the velocity vector C to zero since it is unnecessary to cause the boom 8 to move under machine control. In this case, the target velocity vector T is expressed as "ty=by, tx=bx" if being on the basis of the equation (ty=by +cy, tx=bx+cx) used in S520, and the target velocity vector T matches the velocity vector B by the operator's operation (S540).

In S550, the actuator control section 81 computes target velocities of the hydraulic cylinders 5, 6, and 7 on the basis of the target velocity vector T (ty, tx) determined in S520 or S540. While it is clear from the above description, the target velocity vector T is realized by adding the velocity vector C generated by the motion of the boom 8 under machine control to the velocity vector B in a case in which the target velocity vector T does not match the velocity vector B in FIG. 11.

In S560, the actuator control section 81 computes the target pilot pressures, which are to act on the flow control valves 15*a*, 15*b*, and 15*c* for the hydraulic cylinders 5, 6, and 7, on the basis of the target velocities of the cylinders 5, 6, and 7 calculated in S550.

In S590, the actuator control section 81 outputs target pilot pressures, which are to act on the flow control valves 15*a*, 15*b*, and 15*c* for the hydraulic cylinders 5, 6, and 7, to the solenoid proportional valve control section 44.

The solenoid proportional valve control section 44 controls the solenoid proportional valves 54, 55, and 56 in such a manner that the target pilot pressures act on the flow control valves 15*a*, 15*b*, and 15*c* for the hydraulic cylinders 5, 6, and 7, whereby the work implement 1A performs excavation. For example, in a case where an operator operates the operation device 45*b* to perform horizontal excavation by an arm crowding motion, then the solenoid proportional valve 55*c* is controlled in such a manner that the tip end of the bucket 10 does not enter the target surface 700, and a motion of raising the boom 8 is performed automatically.

It is noted that the control executed as the MC is not limited to the automatic control over the boom raising motion described above, and control may be executed in such a manner as, for example, to automatically rotate the bucket 10 and to keep constant an angle formed between the target surface 700 and a bottom portion of the bucket 10.

<Motions Under MG and Effects of MG>

Motions under the MG performed by the notification control section 374 (controller 40) of the hydraulic excavator 1 will next be described with reference to FIG. 8.

First, in a case in which the hydraulic excavator 1 performs the excavation work while the target surface 700A and the current terrain profile 802A in the area A of FIG. 8 are within the workable range D, the target surface comparison section 62 determines that the target surface 700A closest to the work implement 1A is located below the current terrain profile 802A, selects Step SC109 of FIG. 18, and does not raise the notification content change flag. Owing to this, Steps SB108, 109, and 110 are executed on the basis of the flow of FIG. 11, and the operator is notified of the warning related to the distance between the closest target surface 700A and the bucket 10 via the notification device 53 as depicted in FIG. 12. At that time, a value of the distance between the closest target surface 700A as the MG target and the claw tip of the bucket 10 (target surface distance) is displayed on the notification device 53 as the operation support information, and a light bar (warning) in response to the value of the target surface distance is lit up. Furthermore, a warning sound (warning) in response to the target surface distance is possibly output from the notification device 53 as the operation support information. In other words, there is a probability that the bucket 10 enters the area below the target surface and the current terrain profile is excessively excavated by an excavating motion at the time of performing the excavation work as in this case; thus, the operator is notified of the warning (warning sound and light bar) in response to the target surface distance from the notification device 53. It is thereby possible to prevent excessive excavation of the current terrain profile.

Next, in a case in which the hydraulic excavator 1 performs filling work while the target surface 700B and the current terrain profile 802B in the area B of FIG. 8 are within the workable range D, the target surface comparison section 62 determines that the target surface 700B closest to the work implement 1A is located above the current terrain profile 802B, selects Step SC107 of FIG. 18 by way of Step SC106, and raises the notification content change flag. At this time, the target surface comparison section 62 selects Step SD103 of FIG. 19 and does not raise the MG target surface change flag since the target surface 700C and the current terrain profile 802C in the area C are out of the workable range D. Owing to this, Steps SB105, 106, and 107 are executed on the basis of the flow of FIG. 11, and the operator is notified of the numerical value of the distance between the closest target surface 700B and the bucket 10 via the notification device 53 as depicted in FIG. 13 but not the warning by the warning sound and the light bar. In other words, there is no probability that the current terrain profile is excessively excavated even if the bucket 10 enters the area below the target surface at the time of performing the filling work as in this case; thus, the operator is not notified from the notification device 53 of the warning in response to the target surface distance. Therefore, the operator will not feel troublesome about the unnecessary warning differently from the conventional technique.

Figure 22:
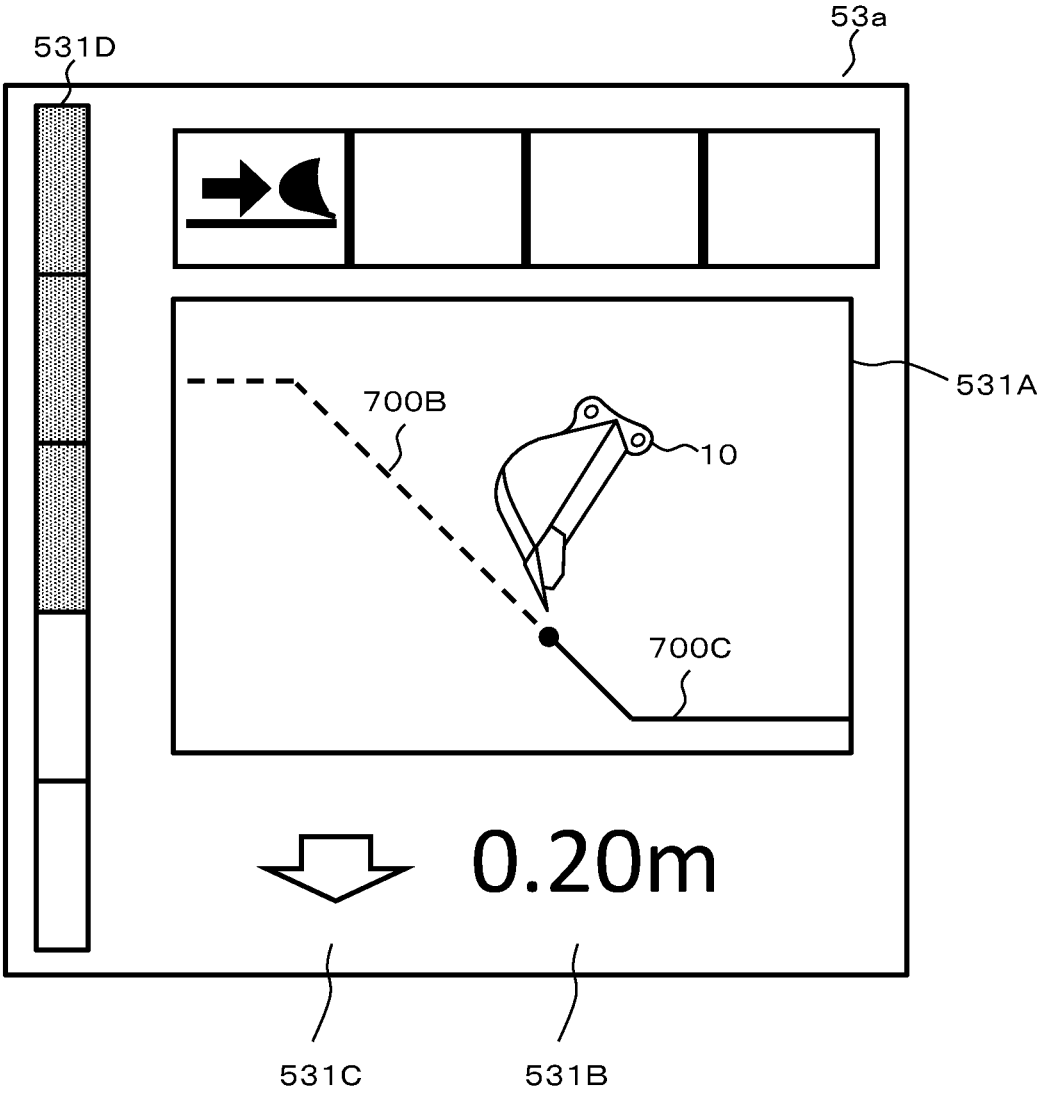
FIG. 22 is an example of a display screen of the notification device 53 in the case in which the notification control section 374 goes to Step SB102 in an example of FIG. 8.

Next, in a case in which the hydraulic excavator 1 performs work near the area B while the target surface 700B and the current terrain profile 802B in the area B and the target surface 700C and the current terrain profile 802C in the area C of FIG. 8 are within the workable range D, the target surface comparison section 62 determines that the target surface 700B closest to the work implement 1A is located above the current terrain profile 802B, selects Step SC107 of FIG. 18 by way of Step SC106, and raises the notification content change flag. At this time, the target surface comparison section 62 selects Step SD102 of FIG. 19 and also raises the MG target surface change flag since the target surface 700C and the current terrain profile 802C in the area C are within the workable range D. Owing to this, Steps SB102, 103, and 104 are executed on the basis of the flow of FIG. 11, and the operator is notified of the warning related to the distance between the moving destination target surface 700C and the bucket 10 via the notification device 53 as depicted in FIG. 22. At that time, a value of the distance between the moving destination target surface 700C as the MG target and the claw tip of the bucket 10 (target surface distance) is displayed on the notification device 53. The operator can thereby easily recognize the distance to the moving destination target surface 700C. Furthermore, the light bar in response to the value of the target surface distance is possibly lit up and warning sound in response to the target surface distance is possibly output from the notification device 53. In other words, there is a probability that the current terrain profile is excessively excavated in the area C adjoining the area B by the motion of the bucket 10 during the filling work upon performing the filling work in the area B as in this case; thus, the operator is notified of the warning (warning sound and light bar) in response to the target surface distance from the notification device 53. It is thereby possible to prevent excessive excavation of the current terrain profile in the excavation work area C adjoining the current filling work area B.

As described above, changing the content of the operation support information of which the operator is notified by the notification device 53 depending on flag information from the target surface comparison section 62 enables the hydraulic excavator in the present embodiment to support the operator's excavating operation without notifying the operator of unnecessary operation support information. For example, in a situation in which filling work is performed on the current terrain profile 800 that is below the target surface 700, production of the warning sound from the notification device 53 and/or lighting-up of the light bar display section 531D possibly causes the operator to feel troublesome. However, according to the present embodiment, it is possible to prevent occurrence of such troublesomeness.

<Motions Under MC and Effects of MC>

Motions under the MC performed by the actuator control section 81 (controller 40) of the hydraulic excavator 1 will next be described.

In the flowchart of FIG. 16, in the case in which the notification content change flag is raised, that is, the target surface comparison section 62 determines that the target surface 700 is located above the current terrain profile 800, then the limit value "ay" is set to the value of FIG. 21 smaller than the value in the case in which the target surface comparison section determines that the target surface 700 is located below the current terrain profile 800 in S430 (that is, the value in the case of FIG. 17). In other words, the limit value "ay" is set to a negative value having a sufficiently large absolute value on the basis of FIG. 21. The actuator control section 81 thereby always selects S530 by way of S450, S480, and S490 in a subsequent process; thus, the vertical component "ty" in the target velocity vector T of the bucket 10 matches the vertical component "by" in the velocity vector B of the bucket 10 by the operator's operation. In other words, the forced boom raising motion for holding the vertical component "ty" to a value equal to or greater than the limit value "ay" (that is, MC) is not executed, and limitation on a motion range of the bucket 10 (work implement 1A) is suspended. Therefore, unnecessary forced boom raising motion is not executed in a situation in which the target surface 700 is above the current terrain profile; thus, it is possible to prevent the operator from having a feeling of strangeness by actuation of the MC unintended by the operator.

On the other hand, in the case in which the notification content change flag is lowered, that is, in the case in which the target surface comparison section 62 determines that the target surface 700 is located below the current terrain profile 800, the limit value "ay" is set on the basis of FIG. 17 in S430. As a result, the forced boom raising motion under the MC is performed as appropriate in response to the relationship between the limit value "ay" (distance D between the target surface 700 and the claw tip) and the vertical component "by" in the velocity vector B of the bucket claw tip by the operator's operation, and the claw tip of the bucket 10 is held on or above the target surface. For example, in a case in which the claw tip is above the target surface 700 and the vertical component "by" is negative (for example, in a case in which the bucket 10 approaches the target surface 700 from above by arm crowding), the actuator control section 81 goes through S490. In this case, a value having a smaller absolute value is selected from between the limit value "ay" and the vertical component "by" as the vertical component "ty" in the target velocity vector T of the bucket, and forced boom raising for the vertical component "cy" is added as appropriate in the case of selecting the limit value "ay." Furthermore, in a case in which the claw tip is below the target surface 700 and the vertical component "by" is negative (for example, in a case in which the bucket 10 is to enter an area further below the target surface 700 by an arm crowding operation), the actuator control section 81 always selects S500 by way of S450 and S460. In other words, the vertical component "ty" in the target velocity vector T is always limited to the limit value "ay," and the forced boom raising for the vertical component "cy" is always added. As a result, while the bucket 10 is caused to move downward by the arm crowding operation (while the vertical component "by" is negative), the boom raising motion is added as appropriate by the MC and a height of the claw tip of the bucket 10 is held to be closer to the target surface 700 (that is, a motion range of the bucket 10 (work implement 1A) is limited to a range on and above the target surface 700); thus, it is possible to perform excavation along the target surface 700.

<Others>

The present invention is not limited to the above embodiment but encompasses various modifications without departing from the spirit of the invention. For example, the present invention is not limited to the work machine configured with all the configurations described in the above embodiment and encompasses the work machine from which part of the configurations are deleted.

In Step SB105 of FIG. 11 described above, the distance information about the distance between the closest target surface 700 and the claw tip of the bucket 10 and information about the direction in which the target surface as the MG target is located with reference to the bucket 10 (information displayed in the numerical value display section 531B and the arrow display section 531C of FIG. 13) are displayed on the notification device 53. Alternatively, in Step SB105, the notification of the distance information and the direction information may be suspended similarly to the warning sound and the light bar for which the notification is suspended in subsequent SB106 and SB107.

Moreover, while it has been described above that the notification content is changed on the basis of states of the two flags, that is, the notification content change flag and the MG target surface change flag, as depicted in FIG. 11, the notification content may be changed only on the basis of the notification content change flag. In this case, the flowchart may be configured such that the notification control section 374 goes to Step SB105 when a determination result is YES in Step SB100 of FIG. 11. Configuring the flowchart in this way similarly makes it possible to prevent the operator from being notified of unnecessary operation support information during the filling work.

Furthermore, the graph of FIG. 21 with respect to the limit value "ay" is given simply as an example, and the limit value "ay" can be used regardless of presence/absence of actuation of the forced boom raising motion (that is, MC) as long as the limit value "ay" per distance D is made smaller than that in the graph of FIG. 17.

While the hydraulic excavator performing the MG and the MC using the notification content change flag has been described above, the hydraulic excavator may be configured to perform only one of the MG and the MC.

DESCRIPTION OF REFERENCE CHARACTERS

1A: Front work implement
8: Boom
9: Arm
10: Bucket
30: Boom angle sensor
31: Arm angle sensor
32: Bucket angle sensor
40: Controller
43: MG/MC control section
43*a*: Operation amount computing section
43*b*: Posture computing section
43*c*: Target surface computing section
44: Solenoid proportional valve control section
45: Operation device (for boom or arm)
46: Operation device (for bucket or swing)
50: Work implement posture sensor
51: Target surface setting device
52*a*: Operator's operation sensor
53: Display device
54, 55, 56: Solenoid proportional valve
62: Target surface comparison section
81: Actuator control section
96: Current terrain profile acquisition device
374: Notification control section

The invention claimed is:

1. A work machine comprising:

a multijoint type work implement;

a plurality of hydraulic actuators that drive the work implement;

an operation device that gives instructions on motions of the hydraulic actuators;

a notification device that notifies an operator of operation support information; and a controller having a notification control section that exercises control as to whether to notify the operator of the operation support information in accordance with a distance between a predetermined target surface, out of a plurality of discretionally set target surfaces, and the work implement, wherein the work machine further comprises a current terrain profile acquisition device that acquires a position of a current terrain profile to be worked by the work implement, the controller having a processor and a memory, the processor configured to:

determine a vertical position relationship between the current terrain profile and a target surface closest to the work implement and a vertical position relationship between the current terrain profile and a target surface adjoining the target surface closest to the work implement in a motion direction of the work implement by comparing the position of the current terrain profile, a position of the target surface closest to the work implement, and a position of the target surface adjoining the target surface closest to the work implement in the motion direction of the work implement, and change content of the operation support information in accordance with a result of the determination.

2. The work machine according to claim 1, wherein the processor is further configured to:

notify the operator of the operation support information in accordance with a distance between a target surface closest to the work implement and the work implement in a case in which the processor determines that the target surface closest to the work implement is located below the current terrain profile, and suspend notification of the operation support information in a case in which the processor determines that the target surface closest to the work implement is located above the current terrain profile.

3. The work machine according to claim 1, wherein the processor is further configured to:

notify the operator of the operation support information in accordance with a distance between a target surface closest to the work implement and the work implement in a case in which the processor determines that the target surface closest to the work implement is located below the current terrain profile, notify the operator of the operation support information in accordance with a distance between a target surface adjoining the target surface closest to the work implement in a motion direction of the work implement and the work implement in a case in which the processor determines that the target surface closest to the work implement is located above the current terrain profile and that the target surface adjoining the target surface closest to the work implement in the motion direction of the work implement is located below the current terrain profile, and suspend notification of the operation support information in a case in which the target surface comparison section determines that the target surface closest to the work implement is located above the current terrain profile and that the target surface adjoining the target surface closest to the work implement in the motion direction of the work implement is located above the current terrain profile.

4. The work machine according to claim 3, wherein the processor is further configured to notify the operator of the distance between the target surface adjoining the target surface closest to the work implement in the motion direction of the work implement and the work implement in a case in which the processor determines that the target surface closest to the work implement is located above the current terrain profile and that the target surface adjoining the target surface closest to the work implement in the motion direction of the work implement is located below the current terrain profile.

5. The work machine according to claim 1, wherein the processor is further configured to control the hydraulic actuators in such a manner that a motion range of the work implement is limited to a range on and above the target surface when the operation device is operated, and wherein the motion range of the work implement limited by the processor is changed in accordance with a result of the determination.

6. The work machine according to claim 5, wherein a limitation on the motion range of the work implement by the processor is suspended in a case in which the processor determines that the target surface closest to the work implement is located above the current terrain profile.

7. The work machine according to claim 1, wherein the processor is further configured to determine the vertical position relationship between the current terrain profile and the predetermined target surface in a case in which the current terrain profile and the predetermined target surface are present within a movable range of the work implement.

* * * * *